US007917047B2

(12) United States Patent
Takishita

(10) Patent No.: US 7,917,047 B2
(45) Date of Patent: Mar. 29, 2011

(54) IMAGE FORMING APPARATUS

(75) Inventor: Shigeki Takishita, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 465 days.

(21) Appl. No.: 12/026,955

(22) Filed: Feb. 6, 2008

(65) Prior Publication Data

US 2008/0187351 A1 Aug. 7, 2008

(30) Foreign Application Priority Data

Feb. 7, 2007 (JP) ..... 2007-028596

(51) Int. Cl.

| | |
|---|---|
| ***G03G 15/00*** | (2006.01) |
| ***G03G 15/01*** | (2006.01) |
| ***G03G 15/16*** | (2006.01) |
| ***G03G 15/20*** | (2006.01) |
| ***G03G 21/00*** | (2006.01) |

(52) U.S. Cl. ..... 399/49; 399/66; 399/99; 399/302; 399/308

(58) Field of Classification Search ..... 399/49, 399/66, 71, 99, 101, 262, 302, 308
See application file for complete search history.

(56) References Cited

U.S. PATENT DOCUMENTS

| | | | | |
|---|---|---|---|---|
| 5,438,398 | A * | 8/1995 | Tanigawa et al. | 399/302 |
| 6,314,264 | B1 * | 11/2001 | Iida et al. | 399/302 |
| 6,496,677 | B2 * | 12/2002 | Fujimori | 399/298 |
| 6,747,682 | B2 * | 6/2004 | Kidoura et al. | 347/189 |
| 2003/0053813 | A1 * | 3/2003 | Kida | 399/49 |
| 2007/0002095 | A1 * | 1/2007 | Ozawa et al. | 347/37 |
| 2008/0118281 | A1 * | 5/2008 | Saeki et al. | 399/308 |

FOREIGN PATENT DOCUMENTS

| | | | |
|---|---|---|---|
| JP | 9-34243 | | 2/1997 |
| JP | 2001-356570 | A | 12/2001 |
| JP | 2005-242178 | A | 9/2005 |
| JP | 2005-331693 | A | 12/2005 |
| JP | 2007025353 | A * | 2/2007 |

OTHER PUBLICATIONS

Computer English-language translation of JP2007-25353 A, Feb. 1, 2007.

* cited by examiner

*Primary Examiner* — David M Gray
*Assistant Examiner* — Francis Gray
(74) *Attorney, Agent, or Firm* — Fitzpatrick, Cella, Harper & Scinto

(57) ABSTRACT

An image forming apparatus includes a toner image forming means for forming a toner image on a belt member, a stretching member that stretches the inside of the belt member, a transfer member, a fur brush, and a controller. The transfer member presses against the stretching member through the belt member, forming a transfer portion for transferring a first toner image onto a recording material. The controller applies a first voltage of a predetermined polarity to the stretching member to transfer the first tone image onto the recording material. During an ejecting operation, the toner image forming member forms a second toner image which is not transferred to the recording material, and the stretching member is supplied with a second voltage that has the predetermined polarity and an absolute value smaller that an absolute value of the first voltage, and subsequently the fur brush electrostatically cleans the transfer member.

3 Claims, 10 Drawing Sheets

IMAGE FORMING APPARATUS

FIELD OF THE INVENTION AND RELATED ART

The present invention relates to an image forming apparatus which forms a throwaway toner image, that is, a toner image which is not to be transferred onto a recording medium, on its image bearing member, based on the history of its usage. More specifically, it relates to the control of the operation for removing the toner on the transferring member(s), which is traceable to the throwaway toner image.

An image forming apparatus, which forms a toner image on its image bearing member or intermediary transfer member with the use of electrically charged toner, and transfers the toner image onto recording medium, with the use of its transfer roller kept in contact with the image bearing member or intermediary transfer member, has been put to practical usage. In order to keep image forming apparatuses of the above-described type stable in image quality, some of them are designed so that they can be operated in a mode for discharging the toner in their developing apparatuses. When they are operated in this mode, a toner image having a specific pattern is formed on their image bearing members to cause their developing apparatuses to expel the toner therein. Hereafter, this toner image having a specific pattern will be referred to as a "throwaway toner image".

Japanese Laid-open Patent Application H07-202710 discloses an image forming apparatus which temporarily suspends an image forming operation to form a throwaway toner image on its photosensitive drum(s), in order to prevent the problem that the two-component developer therein reduces in fluidity, the problem that the toner therein becomes abnormal in the amount of electrical charge, and the like problems. More specifically, this image forming apparatus accumulates the amount of toner consumption deficit relative to a referential value, and then, for every preset number (100) of copies (images) made, it forms a throwaway toner image, the amount of toner in which is proportional to the total amount of toner consumption deficit which occurred during the printing of the preset number (100) of copies (images). The process (which includes charging and exposing steps) used to form this throwaway toner image is the same as the process which is used to form a normal toner image. The thus formed throwaway image is not transferred onto a recording medium, and is removed by the cleaning apparatus disposed next to the photosensitive drum. As for the method for obtaining the total amount of toner consumption deficit, which occurs after a preset number of copies (images) are continuously printed, the cumulative density value of pictorial data is obtained per copy (image), and the amount of difference between the obtained value per copy and the referential cumulative density value (maximum density of 5% per copy) is multiplied by the preset copy count (100).

It is possible that some toner particles in a throwaway toner image will adhere to a transfer roller, and contaminate the back side of a recording medium during the initial period of the image forming operation carried out immediately after the completion of the toner expulsion sequence. Thus, it has been proposed to keep the image forming apparatus on standby for a preset length of time after the completion of the toner expulsion sequence, so that these toner particles can be removed with the use of a cleaning apparatus disposed next to the outward secondary transfer roller, while the image forming apparatus is kept on standby.

However, the time reserved for cleaning the outward secondary transfer roller in many of these image forming apparatuses was unnecessarily long. That is, it kept the image forming apparatuses on standby for a wastefully long time. In other words, it significantly reduced the image forming apparatuses in productivity. On the other hand, in order to ensure that the cleaning will be not be imperfectly done regardless of operational condition, the length of time an image forming apparatus is to be kept on standby for the above-mentioned cleaning operation must be set in consideration of the longest throwaway toner image, that is, the throwaway toner image, the length of which corresponds to the largest total amount of toner consumption deficit.

SUMMARY OF THE INVENTION

The primary object of the present invention is to prevent an image forming apparatus from reducing in productivity, by optimizing the length of the cleaning time.

According to an aspect of the present invention, there is provided an image forming apparatus comprising an image bearing member bearing a normal toner image and a toner pattern; toner image forming means for forming the normal toner image in an image area of said image bearing member and for forming the toner pattern in a non-image-area of said image bearing member; an intermediary transfer member contactable to said image bearing member to form a primary transfer portion for primary transfer, in said primary transfer portion, of the normal toner image from said image bearing member, wherein the toner pattern on said intermediary transfer member is carried to said primary transfer portion; a primary transfer member for transferring the toner image onto said intermediary transfer member from said image bearing member; a secondary transfer member contacted to said image bearing member to form a secondary transfer portion for transferring the normal toner image passing through said secondary transfer portion; toner removing means for removing toner from said secondary transfer member; toner pattern adjusting means for changing an amount of the toner of the toner pattern in accordance with toner image formation hysteresis of said toner image forming means; and cleaning time changing means for changing, in accordance with an amount of toner of the toner pattern, a cleaning duration in which said toner removing means removes the toner from said transfer member in a period from said toner pattern passing through said transfer nip to the recording material reaching the transfer nip.

According to another aspect of the present invention, there is provided an image forming apparatus comprising an image bearing member bearing a normal toner image and a toner pattern; toner image forming means for forming the normal toner image in an image area of said image bearing member and for forming the toner pattern in a non-image-area of said image bearing member; a transfer member contactable to said image bearing member to form a transfer portion for transferring the normal toner image onto a recording material passing therethrough, wherein the toner pattern is fed to said transfer portion; toner removing means for removing toner from said transfer member; toner pattern adjusting means for changing an amount of the toner of the toner pattern in accordance with toner image formation hysteresis of said toner image forming means; and cleaning time changing means for changing, in accordance with an amount of toner of the toner pattern, a cleaning duration in which said toner removing means removes the toner from said transfer member in a period from said toner pattern passing through said transfer nip to the recording material reaching the transfer nip.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a few of the preferred embodiments of the present invention will be described with reference to the appended drawings. The present invention relates to an image forming apparatus, which is provided with an intermediary transfer member or a recording medium bearing member, and is capable of forming a throwaway toner image, that is, a toner image not to be transferred onto recording medium. It is applicable to any image forming apparatus, as long as the image forming apparatus, parts (a part), or the entirety of the structure of which are the same as, or similar to, those of the image forming apparatuses in the following embodiments of the present invention.

In the following description of the embodiments, only the essential portions of the image forming apparatus, which are related to the formation and transfer of a toner image, will be described. However, the present invention is applicable to various forms of image forming apparatus, such as a printer, a copying machine, a facsimile machine, a multifunction image forming apparatus, etc., which are made up of the above-mentioned essential portions, and other devices, equipment, housing, etc., which are necessary for producing documents, pictures, etc.

The commonly known subjects, such as the structure of the developing apparatus, two-component developer, and process control, etc., which are disclosed in Patent Document 1, will not be illustrated to prevent the repetition of the same descriptions.

Embodiment 1

Figure 1:
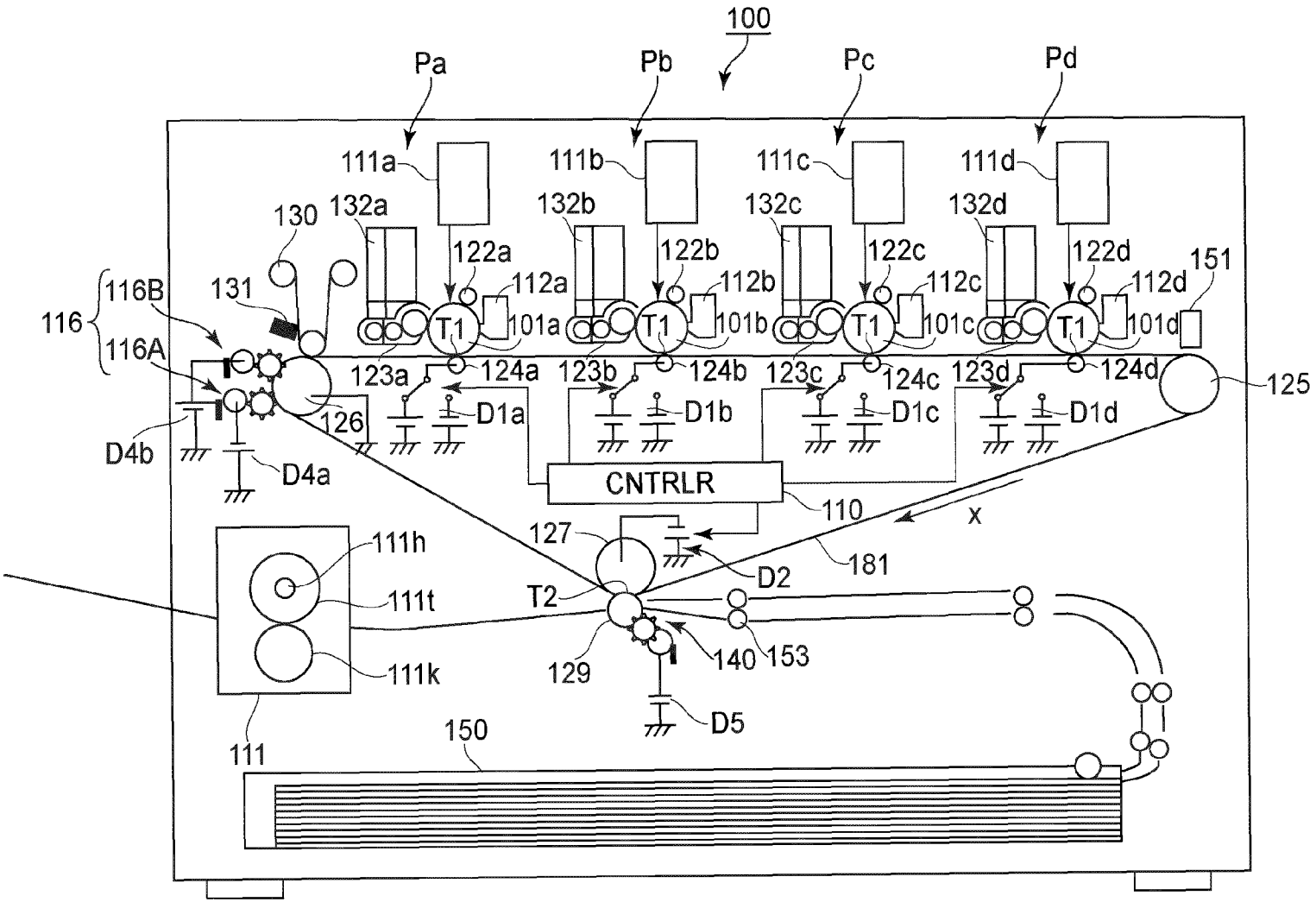
FIG. 1 is a schematic sectional view of the image forming apparatus in the first embodiment of the present invention, showing the structure of the apparatus.
Figure 2:
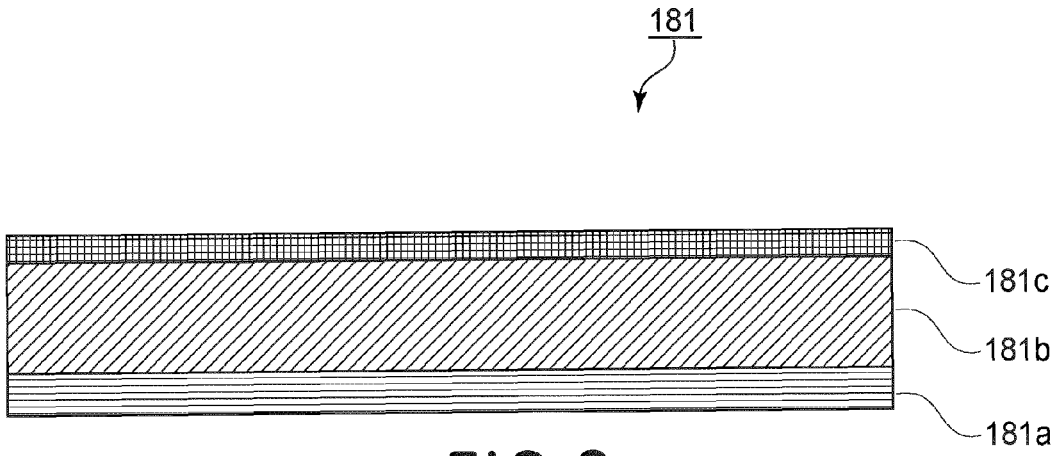
FIG. 2 is a schematic sectional view of the intermediary transfer belt, showing the structure of the belt.

FIG. 1 is a schematic sectional view of the image forming apparatus in the first embodiment of the present invention, and shows the structure of the apparatus. FIG. 2 is a schematic sectional view of the intermediary transfer belt, and shows the structure of the belt. The image forming apparatus 100 in the first embodiment is a full-color image forming apparatus of the so-called tandem type. It has yellow, magenta, cyan, and black image forming portions Pa, Pb, Pc, and Pd, which are juxtaposed in the adjacencies of the outward side of the top portion of the loop which the intermediary transfer belt 181 forms.

Referring to FIG. 1, the intermediary transfer belt 181, which is an example of an intermediary transfer member, is stretched around a driver roller 125, a follower roller 126, and a secondary transfer roller 127, being thereby suspended by the three rollers. The driver roller 125 is rotationally driven by an unshown motor (for example, stepping motor). As the driver roller 125 is rotationally driven, it circularly moves the intermediary transfer belt 181 in the direction indicated by an arrow mark X, at a peripheral velocity of 301 mm/sec. The intermediary transfer belt 181 is an elastic belt made up of three layers, that is, a resin layer 181*a*, an elastic layer 181*b*, and a surface layer 181*c*.

Referring to FIG. 1, the areas of contact between the photosensitive drums 101*a*, 101*b*, 101*c*, and 101*d* of the image forming portions Pa, Pb, Pc, and Pd, respectively, and the intermediary transfer belt 181, constitute the transfer areas T1. The image forming portions Pa, Pb, Pc, and Pd are the same in structure, although they are different in the color (yellow, magenta, cyan, or black) of the toner they use in their developing apparatuses 123*a*, 123*b*, 123*c*, and 123*d*, respectively. Thus, only the image forming apparatus Pa will be described in detail, assuming that the structure of the image forming portions Pb, Pc, and Pd can be easily understood by replacing the referential letter "a" assigned to the image forming portion for forming a yellow toner image, with "b, c, or d".

The image forming portion Pa has the photosensitive drum 101*a*, which is an example of an image bearing member. The photosensitive drum 101*a* rotates at roughly the same peripheral velocity as the intermediary transfer belt 181. It is made up of an aluminum cylinder, and a layer of organic photoconductor (OPC) coated on the entirety of the peripheral surface of the aluminum cylinder. The photosensitive drum 101*a* is rotatably supported at both of its lengthwise ends by a pair of flanges, one for one.

The photosensitive drum 101*a* is rotationally driven in the clockwise direction of the drawing, by the driving force transmitted from an unshown motor. The image forming portion Pa also has a charging apparatus 122*a*, an exposing apparatus 111*a*, a developing apparatus 123*a*, a transfer roller 124*a*, and a cleaning apparatus 112*a*, which are arranged in the adjacencies of the peripheral surface of the photosensitive drum 101*a*.

Prior to the formation of an electrostatic image, the charging apparatus 122*a* uniformly charges the peripheral surface of the photosensitive drum 101*a* to a preset potential level. The charging apparatus 122*a* is an electrically conductive roller, which rotates in contact with the peripheral surface of the photosensitive drum 101*a*. To the charge roller 122*a*, charge voltage is applied from an unshown electric power source.

The exposing apparatus 111*a*, which is an example of an electrostatic latent image forming means, writes an electrostatic latent image, which corresponds to the yellow color component of an original, on the peripheral surface of the photosensitive drum 101*a*. More specifically, it emits a beam of laser light while pulse modulating the beam with pictorial signals which correspond to the yellow color component of the original. The beam of laser light is reflected by the rotating mirror of the exposing apparatus 111*a* in a manner of scanning the peripheral surface of the photosensitive drum 101*a*. As a result, an electrostatic latent image is effected on the peripheral surface of the photosensitive drum 101*a*. Incidentally, the exposing apparatus 111*a* may be replaced with an LED array which can be turned on or off by an unshown driver circuit, in response to the pictorial signals.

The developing apparatus 123*a*, which is an example of a developing means, mixes the toner supplied from a toner bottle 132*a* with magnetic carrier, charging thereby the toner. The charged toner develops the electrostatic image on the photosensitive drum 101*a*, which is an example of an image bearing member, into a toner image by being electrostatically adhered to the electrostatic image.

In this embodiment, a developing method which reversely develops an electrostatic latent image is employed. That is, the toner is charged to the negative polarity. More specifically, the charging apparatus 122*a* negatively charges the peripheral surface of the photosensitive drum 101*a* to −500 V, for example. As the peripheral surface of the photosensitive drum 101*a* is exposed by the exposing apparatus 111*a*, the numerous exposed points of the peripheral surface of the photosensitive drum 101*a* reduced in potential to −150 V. For the development of a latent image, −350 V of development voltage is used to adhere the negatively charged toner to the numerous points of the peripheral surface of the photosensitive drum 101*a*, which have been reduced in potential.

The transfer roller 124*a* is always kept pressed against the photosensitive drum 101*a* with the presence of the intermediary transfer belt 181 between the transfer roller 124*a* and peripheral surface of the photosensitive drum 101*a*, forming thereby a transfer portion T1, which is an example of a transferring portion, between the photosensitive drum 101*a* and intermediary transfer belt 181.

A transfer power source D1*a*, which is an example of an electric power supplying means, electrostatically moves the toner image from the photosensitive drum 101*a* onto the intermediary transfer belt 181, by outputting voltage, the polarity of which is opposite to that of the normal charged toner, to the transfer roller 124*a*.

The cleaning apparatus 112*a* removes the transfer residual toner by scraping the peripheral surface of the photosensitive drum 101*a* with its cleaning blade. Incidentally, the transfer residual toner is the toner which moved through the transfer portion T1, in other words, the toner which was not transferred onto the intermediary transfer belt 181.

First, a yellow toner image is formed on the peripheral surface of the photosensitive drum 101*a*. Then, the yellow toner image is transferred onto the intermediary transfer belt 181 in the transfer portion T1. Then, the yellow toner image on the intermediary transfer belt 181 is moved into the transfer portion T1, which corresponds to the photosensitive drum 101*b*. By the time the yellow toner image on the intermediary transfer belt 181 reaches the transfer portion T1 for the image forming portion Pb, a magenta toner image will have been formed on the portion of the peripheral surface of the photosensitive drum 101*b*, through the same steps as those through which the yellow toner image was formed. This magenta toner image is transferred in layers onto the yellow toner image on the intermediary transfer belt 181, in the transfer portion T1 which corresponds to the photosensitive drum 101*b*.

Similarly, a cyan toner image is transferred in layers onto the yellow and magenta toner images on the intermediary transfer belt 181, in the transfer portion T1, which corresponds to the photosensitive drum 101*c*. Lastly, a black toner is transferred in layers onto the yellow, magenta, cyan toner images on the intermediary transfer belt 181, in the transfer portion T1, which corresponds to the photosensitive drum 101*d*. That is, the four monochromatic toner images, which are different in color, are transferred onto the intermediary transfer belt 181 in the image forming portions Pa, Pb, Pc, and Pd, respectively. Then, they are conveyed by the movement of the intermediary transfer belt 181 into the secondary transfer portion T2, in which they are transferred together (secondary transfer) onto a sheet of recording medium 8 (which hereafter will be referred to simply as recording medium). Incidentally, regarding the recording medium 8, the image forming apparatus 100 is fitted with a sheet feeder cassette 150, in which a substantial number of recording mediums 8 are stored. The recording mediums 8 are fed one by one from the sheet feeder cassette 150 into the main assembly of the image forming apparatus 100. As each recording medium 8 is fed into the main assembly, it is kept on standby by a pair registration rollers 153, and then, is released, and conveyed further, by the registration rollers 153 with such timing that the recording medium 8 arrives at the secondary transfer portion T2 at the same time as the four monochromatic toner images, different in color, on the intermediary transfer belt 181 arrive at the secondary transfer portion T2.

An outside secondary transfer roller 129 is a rubber roller made up of an electrically conductive spongy substance. It is kept pressed against the aforementioned inside secondary transfer roller 127, which is disposed on the inward side of the belt loop, with the presence of the intermediary transfer belt 181 between the two rollers 129 and 127, forming thereby the secondary transfer portion T2 between the intermediary transfer belt 181 and outside secondary transfer roller 129. The outside secondary transfer roller 129 has three layers, that is, a spongy layer formed of epichlorohydrin, a solid layer, and a surface layer formed of fluorine coated on the solid layer.

The outside secondary transfer roller 129 is grounded. To the inside secondary transfer roller 127, transfer voltage is applied from a transfer voltage power source D2. Thus, an electric field which electrostatically transfers the four monochromatic color toner images on the intermediary transfer belt 181, onto the recording medium 8, is formed between the inside and outside transfer rollers 127 and 129.

After the transfer of the four monochromatic color toner images onto the recording medium in the secondary transfer portion T2, the recording medium is separated from the intermediary transfer belt 181, and is conveyed to a fixing apparatus 111. In the fixing apparatus 111, the recording medium is conveyed through a fixation nip, which a fixation roller 111*t* heated by a heater 111*h*, and a pressure roller 111*k*, form. As a result, the four monochromatic toner images are subjected to heat and pressure, becoming thereby fixed to the surface of the recording medium.

The transfer residual toner on the intermediary transfer belt 181, that is, the toner which was not transferred onto the recording medium in the secondary transfer portion T2, is conveyed to the cleaning apparatus 116 by the movement of the intermediary transfer belt 181, and is electrostatically removed. The cleaning apparatus 116 is made up of an upstream cleaning portion 116*a* and a downstream cleaning portion 116*b*. The upstream cleaning portion 116*a* is provided with an electrically conductive fur brush, which is placed in contact with the intermediary transfer belt 181. The fur brush is negatively charged by an electric power source D4*a*, and is rotational driven. It adsorbs (removes) from the intermediary transfer belt 181 the reversely charged toner which is the primary component of the transfer residual toner. The downstream cleaning portion 116*b* is also provided with an electrically conductive fur brush, which is placed in contact with the intermediary transfer belt 181. This fur brush, however, is positively charged by an electric power source D4*b*, and is rotational driven. It adsorbs (removes) from the intermediary transfer belt 181 the negative charged toner which is created by the upstream cleaning portion 116*a*.

The image forming apparatus 100 is provided with a cleaning apparatus 140, which is disposed in contact with the outside secondary transfer roller 129, in order to electrostatically remove the toner on the outside secondary transfer roller 129 (toner having transferred onto outside secondary transfer roller 129 from intermediary transfer belt 181, which is always in contact with outside secondary transfer roller 129), in the secondary transfer portion T2.

The uncharged (or insufficiently charged) toner particles which were not removed by the cleaning apparatus 116 are conveyed to a cleaning apparatus 130 located on the downstream of the cleaning apparatus 116, and are removed by the cleaning apparatus 130. The cleaning apparatus 130 is provided with a roll of cleaning web, which is unrolled by several millimeters per every preset number of images made. The cleaning web is placed in contact with the intermediary transfer belt 181 to capture the toner particles on the intermediary transfer belt 181, in order to clean the intermediary transfer belt 181. The end of the cleaning web is detected by a sensor 131.

The amount of the transfer current which flowed in the transfer portions T1 and T2 in normal image forming operation are given in Table 1.

TABLE 1

| Normal image formation | | | | |
|---|---|---|---|---|
| | Low H | Normal H | High H | Remarks |
| 1ry trans. cur. μA | 30 | 30 | 30 | ATVC const. V |
| 2ry trans. cur. μA | −55 | −50 | −45 | ATVC const. V |
| External roller cleaning cur. μA | 12.5 | 12.5 | 12.5 | Const. cur. |

A control portion 110 causes the electric power source D1*a* (which is an electric power source for image transfer) to output several voltages different in magnitude, and measures the amount of the current flowed by each of the voltages, while an image is not formed. Then, from the results of current amount measurement, it obtains by computation the amount of transfer voltage capable of flowing a preset mount of transfer current, which in this embodiment is 30 μA. Then, during a normal image forming operation, it causes the transfer power source D1*a* to output the transfer voltage so that its value remains at the level determined by the computation. Normally, the control portion 110 controls the transfer power source D1*a* to output transfer voltage which is kept in a range of +500 V to +1,000 V by automatic transfer voltage control (ATVC), to the transfer roller 124*a*, in order to transfer (primary transfer) a toner image on the photosensitive drum 101*a* onto the intermediary transfer voltage belt 181.

Further, the control portion 110 causes the electric power source D2*a* (which is also an electric power source for image transfer) to output several voltages different in magnitude, and measures the amount of the current flowed by each of the voltages, while an image is not formed. Then, from the results of current amount measurement, it obtains by computation the amount of transfer voltage capable of flowing a preset mount of transfer current, which in this embodiment is in a range −55 to 45 μA. Then, when the recording medium is conveyed through the transfer portion T2, it causes the transfer power source D1*a* to output the transfer voltage so that its value remains at the level determined by the computation. Normally, the control portion 110 controls the transfer power source D2 to output a transfer voltage which is in a range of −1,000 V to 4,000 V, to the inside secondary transfer roller 127*a* in order to transfer (secondary transfer) a toner image (formed of negatively charged toner) on the intermediary transfer belt 181 onto the recording medium.

To the electrically conductive fur brushes (143*a* and 143*b* in FIG. 4) of the cleaning apparatus 140, positive voltage is applied to cause 12.5 μA of current to flow under the constant current control. As a result, the negatively charged toner is adsorbed by the fur brushes from the outside secondary transfer roller 129, which is grounded.

Figure 7:
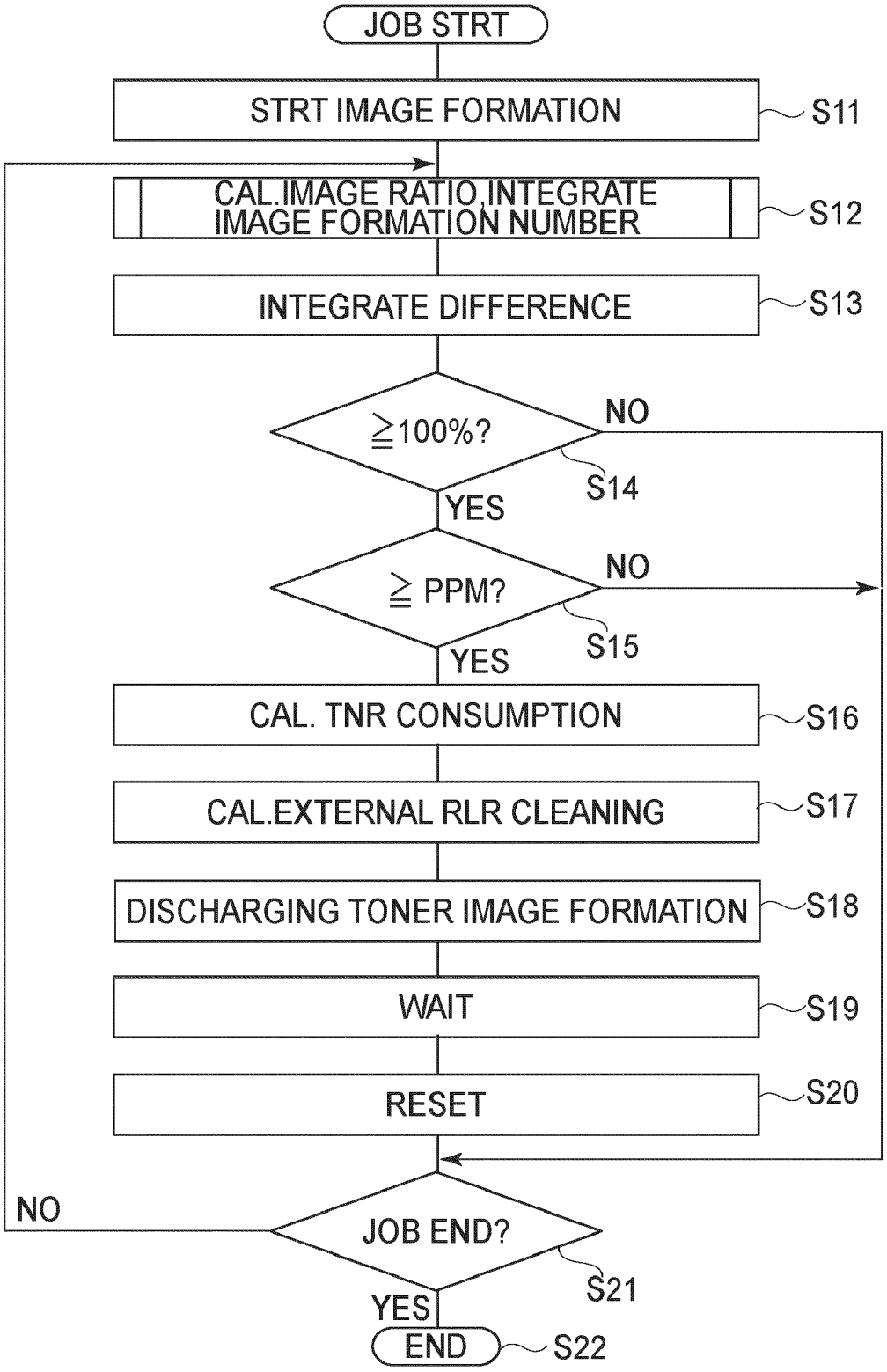
FIG. 7 is a flowchart of the toner expulsion sequence in the first embodiment.

The image forming apparatus 100 has a controlling means (110) and a first adjusting means (110). The controlling means (110) controls the sequence for expelling the toner from the developing apparatus 123*a* onto the area of the peripheral surface of the image bearing member (101*a*), across which an image is not formed. The first adjusting means adjusts the amount by which toner is expelled from the developing apparatus 123*a* according to the toner image formation history of the developing apparatus 123*a*. The image forming apparatus 100 also has a second adjusting means (110) which adjusts the length of the cleaning time t2 so that the cleaning time t2 for the cleaning apparatus 140 to remove the toner expelled from the transfer member (129) when the amount of the toner expelled from the developing apparatus 123*a* is shorter than that when the amount of expelled toner is large. In FIG. 7, which is the flowchart of the toner expulsion sequence controlled by the control portion 110, Steps S18, S16, and S17 correspond to the toner expulsion controlling means, first adjusting means, and second adjusting means, respectively.

The image forming apparatus 100 has multiple image bearing members (101*a*, 101*b*, 101*c*, and 101*d*) which are different in the color in which they develop an electrostatic latent image. The multiple image bearing members are disposed along the intermediary transfer member (181). In a toner expulsion sequence, toner is expelled from the developing apparatuses (123*a*, 123*b*, 123*c*, and 123*d*) onto the image bearing members (101*a*, 101*b*, 101*c*, and 101*d*), by the above-mentioned amounts, respectively, so that the expelled toner will be transferred on the same portion of the intermediary transfer member (181).

For every preset number of copies (images) outputted through a normal image forming operation, the toner expulsion controlling means (image size adjusting means 110) causes the image forming apparatus to form a throwaway toner image on the image bearing member (101*a*) using the same process as that used to output a normal toner image. A throwaway toner image is the same in width and density as a normal image, and is uniform in density. The first adjusting means (110) sets the length of a throwaway toner image, which will be formed in the toner expulsion sequence, according to the total amount of toner consumption deficit, which occurred during the preceding period of the normal image forming operation, in which the preset number of normal images has been formed.

The cleaning apparatus 140 is an electrostatic cleaning apparatus, that is, a cleaning apparatus which electrostatically adsorbs (removes) the toner particles having adhered to the surface of an object to be cleaned.

<Developing Apparatus>

Figure 3:
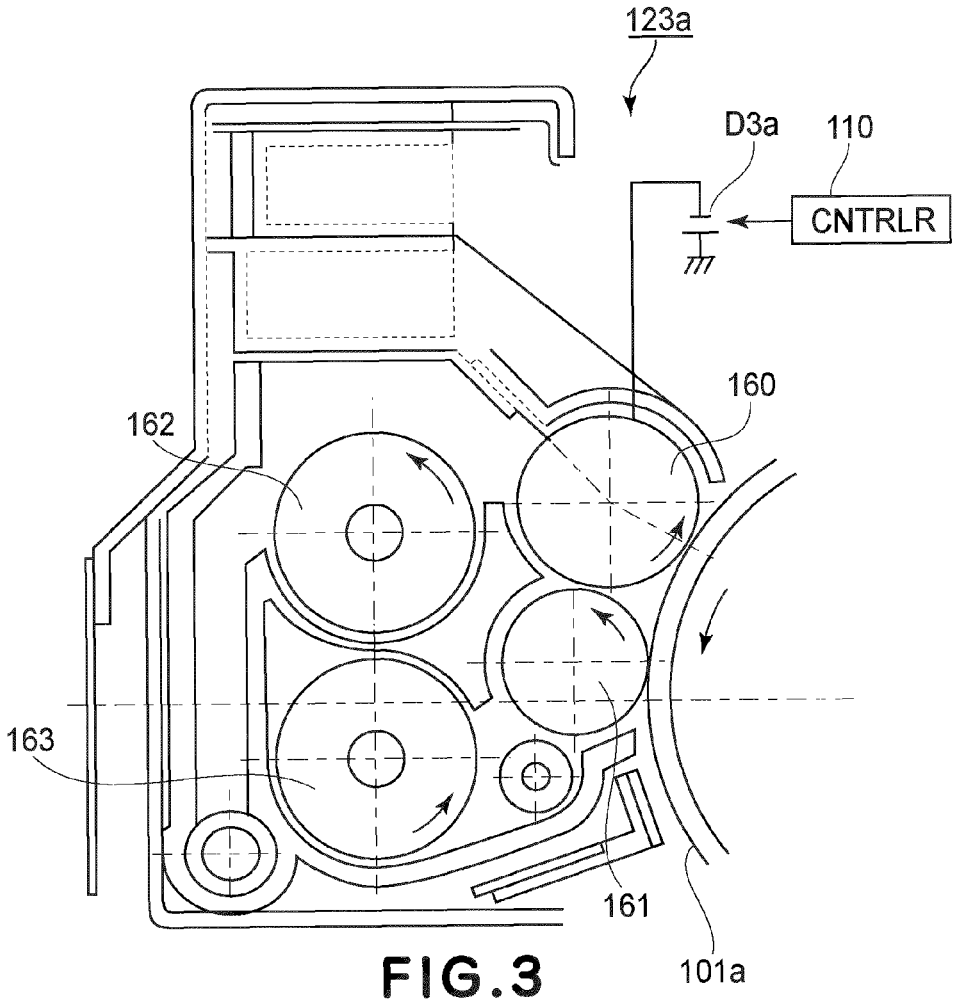
FIG. 3 is a schematic sectional view of the essential portion of the developing apparatus.

FIG. 3 is a schematic sectional view of the essential portions of the developing apparatus. As will be evident from FIG. 3, the developing apparatus 123*a* is of the so-called double-gap type. In other words, it has two development sleeves which bear toner to develop an electrostatic latent image on the photosensitive drum 101*a*, being therefore significantly greater in process speed than a developing apparatus employing only a single development sleeve. The developing apparatus 123*a* is supplied with toner, by the amount equal to the amount of toner consumed by the developing apparatus 123*a*, by a toner bottle (132*a* in FIG. 1) which is a toner storage in which unused yellow toner is stored. The normal polarity to which the yellow toner used in the developing apparatus 123*a* is chargeable is negative.

The developing apparatus 123*a* is filled with two-component developer, which is a mixture of magnetic carrier, external additive, and yellow toner. It is provided with a pair of screws 162 and 163 which convey the developer in the developing apparatus 123*a* in the direction perpendicular to the surface of the paper on which is FIG. 3 is drawn. The developer conveying screws 162 and 163 are opposite in the direction they convey the developer. The unused toner is delivered from the toner bottle (132*a* in FIG. 1) to the rear end of the developer conveying screw 162, and is conveyed frontward by the screw 162 while being stirred by the screw 162, being thereby mixed with the old developer in the developing apparatus 123*a*. Then, the mixture of the unused toner and old toner is given to the developer conveying screw 163.

The developer conveying screw 163 supplies the development sleeve 161 with the developer while it conveys, by being rotated, the developer rearward from the front end of the developing apparatus 123*a*. As the development sleeve 161 is supplied with the developer, the developer on the development sleeve 161 is formed into a thin layer of developer, and develops an electrostatic latent image on the photosensitive drum 101*a* while it is moved through the area in which the peripheral surface of the development sleeve 161 is virtually in contact with the peripheral surface of the photosensitive drum 101*a*. After the thin layer of developer on the development sleeve 161 is used for the development of the electrostatic image on the photosensitive drum 101*a*, it is transferred onto the development sleeve 160, being thereby coated in thin layer on the peripheral surface of the development sleeve 160. Then, it is used again for developing the latent image on the peripheral surface of the photosensitive drum 101*a* as it is moved through the area in which the peripheral surface of the development sleeve 160 is virtually in contact with the peripheral surface of the photosensitive drum 101*a*. The toner having overflowed from the development sleeve 160 without contributing to the development, circulates back to the developer conveying screw 162.

The development sleeves 160 and 161 are rotationally driven by an unshown driving portion. They rotate at a high speed around a magnetic roller located in the hollow of each of the development sleeves 160 and 161 so that the rotational axis of each development sleeve coincides with the axial line of the magnetic roller. As a given portion of the peripheral surface of the development sleeve is moved to the area which corresponds to one of the magnetic pole of the magnetic roller in the development sleeve, the toner on this portion crests, coming into contact with the peripheral surface of the photosensitive drum 101*a*. To the development sleeves 160 and 161, development voltage, which is a combination of negative DC voltage and AC voltage, the amplitude of which is greater than the magnitude of the DC voltage, is applied.

While images are continuously formed, the developer conveying screws 162 and 163 in the developing apparatus 123*a* continue to rotate, continuously mixing the toner and magnetic carrier. Thus, the toner gradually increases in the amount of electric charge. The amount of toner charge, state of the adhesion of external additives to toner particles, shape of a toner particle, average particles diameter of toner, etc., are kept normal by the delivery of no less than a preset amount of toner to the developing apparatus 123*a*. Therefore, in a case where images which are small in the amount of the toner necessary for their formation are continuously formed, the toner in the developing apparatus 123*a* is not consumed by the preset amount, causing the developing apparatus 123*a* to unsatisfactorily perform.

More specifically, if a substantial number of copies which are no more than 2% in image ratio are continuously produced, toner particles are not given a proper amount of electric charge, making it therefore likely for the developing apparatus 123*a* to develop an electrostatic image into an unsatisfactory toner image, that is, a toner image which appears rough, is nonuniform in density, and/or suffers from fog.

Thus, in the case of the image forming apparatus 100, a throwaway toner image, that is, a toner image which is not to be transferred onto recording medium, is formed on the photosensitive drum 101*a* for every 70 copies made to compensate for the amount of toner consumption deficit which occurred while 70 copies were continuously made.

<Cleaning Apparatus>

Figure 4:
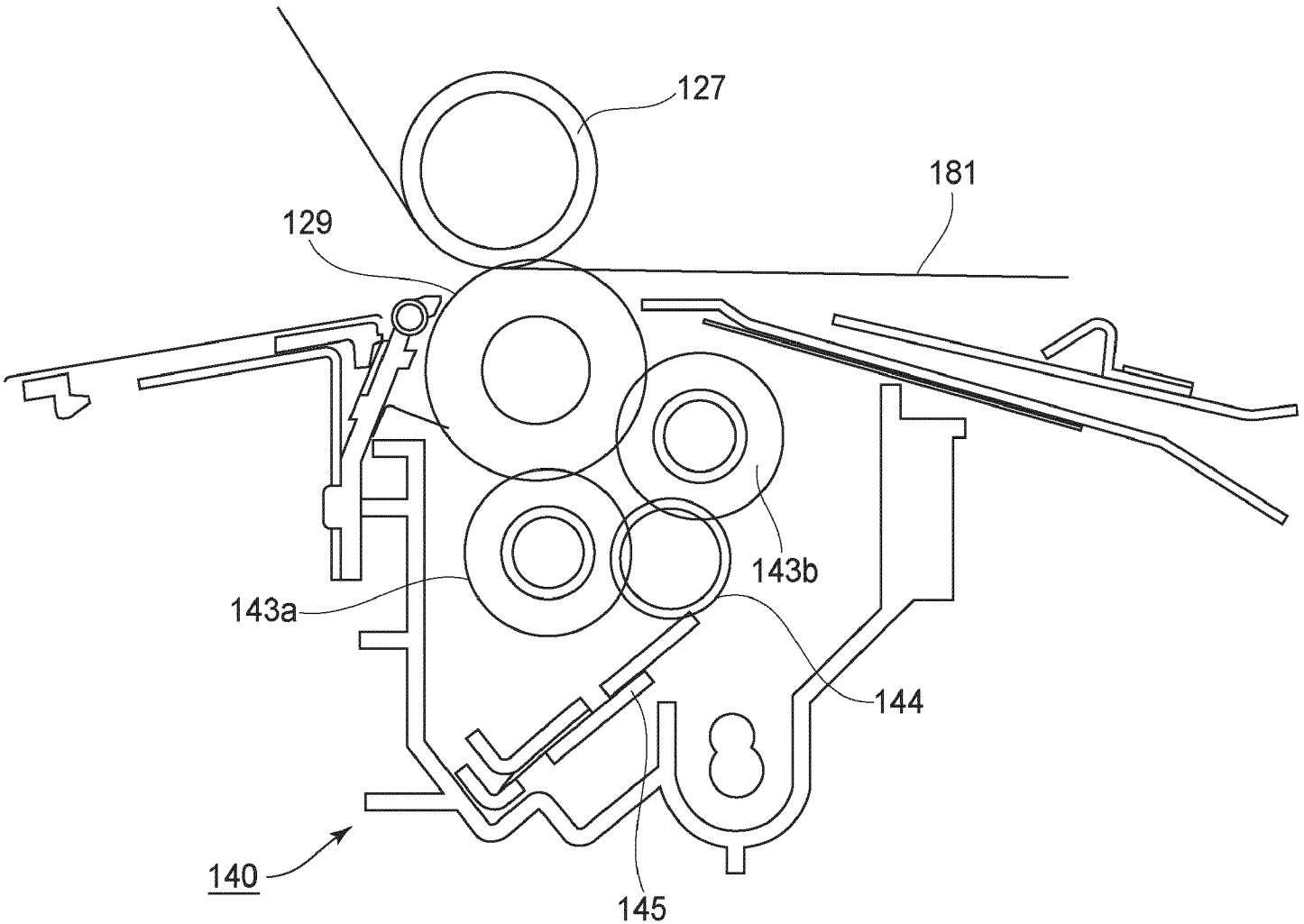
FIG. 4 is a schematic sectional view of the cleaning apparatus disposed next to the outward secondary transfer roller (transfer roller located on outward side of loop which intermediary transfer belt forms), and shows the general structure of the cleaning apparatus.

FIG. 4 is a schematic sectional view of the cleaning apparatus located next to the outside secondary transfer roller, and shows the structure of the cleaning apparatus. As shown in FIG. 4, the outside secondary transfer roller 129 is kept pressed against the inside secondary transfer roller 127 with the presence of the intermediary transfer belt 181 between the two rollers 127 and 129. The outside secondary transfer roller 129 rotates at roughly 301 mm/sec (which compares to process speed of 300 mm/sec, at which recording medium is conveyed). Mechanically, the developing apparatus 123*a* is structured so that the outside secondary transfer roller 129 and cleaning apparatus 140 can be separated together from the intermediary transfer belt 181, making it possible to provide a preset amount of gap between the intermediary transfer belt 181 and outside secondary transfer roller 129 in the secondary transfer portion T2, when the image forming apparatus 100 is kept on standby, or is restored from paper jam or the like.

When the image forming apparatus 100 is kept on standby, the outside secondary transfer roller 129 is separated from the intermediary transfer belt 181 to prevent the outside secondary transfer roller 129 from being frictionally worn. The reason for the separation of the outside secondary transfer roller 129 from the intermediary transfer belt 181 is as follows: If a paper jam occurred, it is possible that there will be a high density toner image on the intermediary transfer belt 181. Thus, unless the outside secondary transfer roller 129 is separated from the intermediary transfer belt 181, it is possible that the outside secondary transfer roller 129 will come into contact with the high density toner image, and therefore, a large amount of toner will adhere to the outside secondary transfer roller 129, during the recovery of the image forming apparatus 100 after the completion of the operation for removing the jammed recording medium. Thus, the outside secondary transfer roller 129 is kept separated from the intermediary transfer belt 181 to prevent the toner on the intermediary transfer belt 181 from adhering to the outside secondary transfer roller 129. As for the toner remaining on the intermediary transfer belt 181, it is transferred back onto the photosensitive drum 101*a*, and is recovered.

Incidentally, while a substantial number of copies are continuously printed, the outside secondary transfer roller 129 is kept in contact with the intermediary transfer belt 181, even while the portions of the intermediary transfer belt 181, across which no image has been transferred, are conveyed through the secondary transfer portion T2, in order to prevent the vibrations which might occur as the outside secondary transfer roller 129 is separated from, or placed in contact with, the intermediary transfer belt 181. Therefore, as the outside secondary transfer roller 129 comes in contact with the portion of the intermediary transfer belt 181, which corresponds to the paper intervals, while a substantial number of copies are continuously printed, the toner remaining adhered to the intermediary transfer belt 181 is transferred onto the outside secondary transfer roller 129.

Thus, if the next imaging operation is carried out with the toner remaining adhered to the outside secondary transfer roller 129, the toner adheres to the back surface of the recording medium, and is fixed to the back surface of the recording medium, permanently soiling thereby the back surface of the recording medium. This is why the image forming apparatus 100 is provided with the cleaning apparatus 140 which has the electrostatic fur brushes capable of very efficiently removing toner even from the surface of a flexible object to be cleaned. The cleaning apparatus 140 is disposed next to the outside secondary transfer roller 129.

The cleaning apparatus 140 is provided with a pair of electrically conductive fur brushes 143*a* and 143*b*. The conductive fur brush 143*a* is positioned so that it is in contact with the outside secondary transfer roller 129 in one area, and a bias roller 144 in another area. The conductive fur brush 143*b* is positioned so that it is in contact with the outside secondary transfer roller 129 in an area different from the area in which the fur brush 143*a* is in contact with the outside secondary transfer roller 129, and the bias roller 144 in an area different from where the conductive fur brush 143*a* is in contact with the bias roller 144. The conductive fur brushes 143*a* and 143*b*, and bias roller 144 are driven by the driving force transmitted thereto from the same driving force source as the mechanism for rotationally driving the outside secondary transfer roller 129. The rotational direction of the conductive fur brush 143*a* and 143*b* is the same as that of the outside secondary transfer roller 129. More specifically, the conductive fur brushes 143*a* and 143*b* rotate at a rotational speed of 400 rpm in such a direction that in the areas of contact between the two rollers 143*a* and 143*b* and outside secondary transfer roller 129, their peripheral surfaces move in the opposite direction as the moving direction of the peripheral surface of the outside secondary transfer roller 129, mechanically scraping away the toner having adhered to the peripheral surface of the outside secondary transfer roller 129.

To the bias roller 144, positive voltage is applied from an electric power source D5 under the constant current control so that 12.5 μA of current continuously flows. Thus, the conductive fur brushes 143*a* and 143*b* are positively charged by the bias roller 144, and electrostatically remove the negatively charged toner having adhered to the peripheral surface of the outside secondary transfer roller 129. After being electrostatically adhered to the conductive fur brushes 143*a* and 143*b*, the negatively charged toner is electrostatically transferred onto the bias roller 144, and is scraped away by the cleaning blade 145.

Referring to FIG. 1, when the image forming apparatus 100 is operated in the mode for forming a throwaway toner image, transfer prevention voltage, which is opposite in polarity to the transfer voltage which is applied to transfer a toner image from the photosensitive drum 101*a* onto the intermediary transfer belt 181 in the transfer portion T1, is applied to the transfer roller 124*a*. Therefore, the throwaway toner image virtually entirely remains on the photosensitive drum 101*a*, and is removed by the cleaning apparatus 112*a*, which is disposed next to the photosensitive drum 101*a*.

However, the application of the transfer prevention voltage cannot keep the entirety of the throwaway toner image on the photosensitive drum 101*a*; it cannot prevent the entirety of the throwaway toner image from transferring onto the intermediary transfer belt 181, for the following reason. That is, in the transfer portion T1, the transfer roller 124*a* is kept pressed against the photosensitive drum 101*a* with the application of roughly 0.1 N of force. Thus, even if the voltage to be applied to the transfer roller 124*a* is set so that the throwaway toner image is prevented from transferring, some portions of the throwaway toner image are transferred onto the intermediary transfer belt 181 by the contact pressure in the transfer portion T1, that is, by being pressed upon the intermediary transfer belt 181. The amount by which the throwaway toner image is transferred by the contact pressure is affected by the state of the surface of the intermediary transfer belt 181 as well as the surface properties of the intermediary transfer belt 181. Thus, it cannot be avoided that a certain amount of toner particles in the throwaway toner image are transferred onto the intermediary transfer belt 181.

The toner particles which transferred from the throwaway toner image formed on the photosensitive drum 101*a* onto the intermediary transfer belt 181 and adhered to the intermediary transfer belt 181 adhere to the outside secondary transfer roller 129 when they are moved through the secondary transfer portion T2 by the intermediary transfer belt 181.

Therefore, a certain amount of time is provided to clean the outside secondary transfer roller 129 after the portion of the intermediary transfer belt 181, on which the toner particles having transferred from the throwaway toner image on the photosensitive drum 101*a*, are present, is moved through the second transfer portion T2. That is, the restarting of the interrupted normal image forming operation is delayed for cleaning the outside secondary transfer roller 129. During this cleaning period, the toner particles on the outside secondary transfer roller 129, which are traceable back to the throwaway toner image, are removed by the cleaning apparatus 140.

<Expulsion Control>

Figure 5:
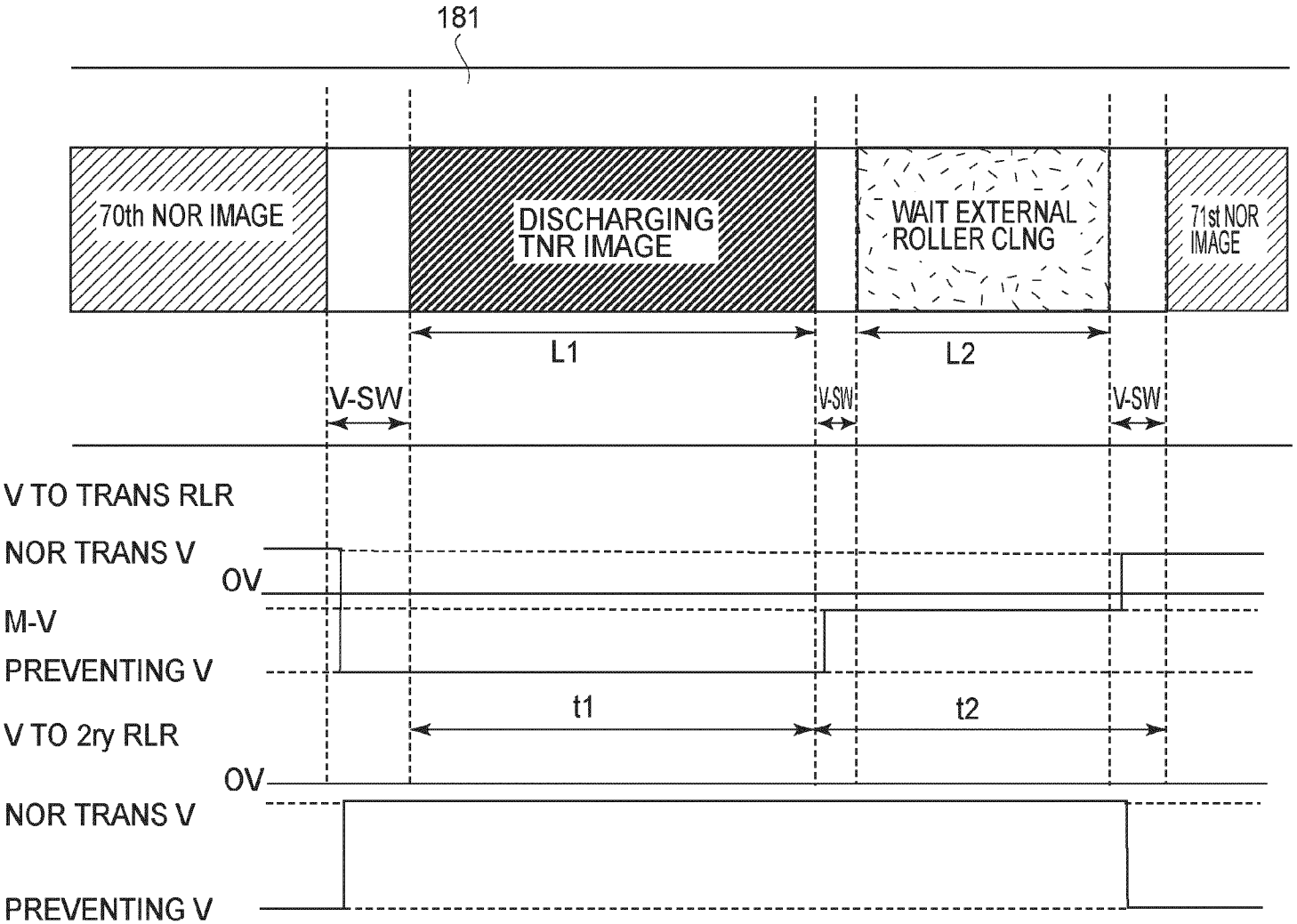
FIG. 5 is a timing chart of the toner expulsion sequence.
Figure 6:
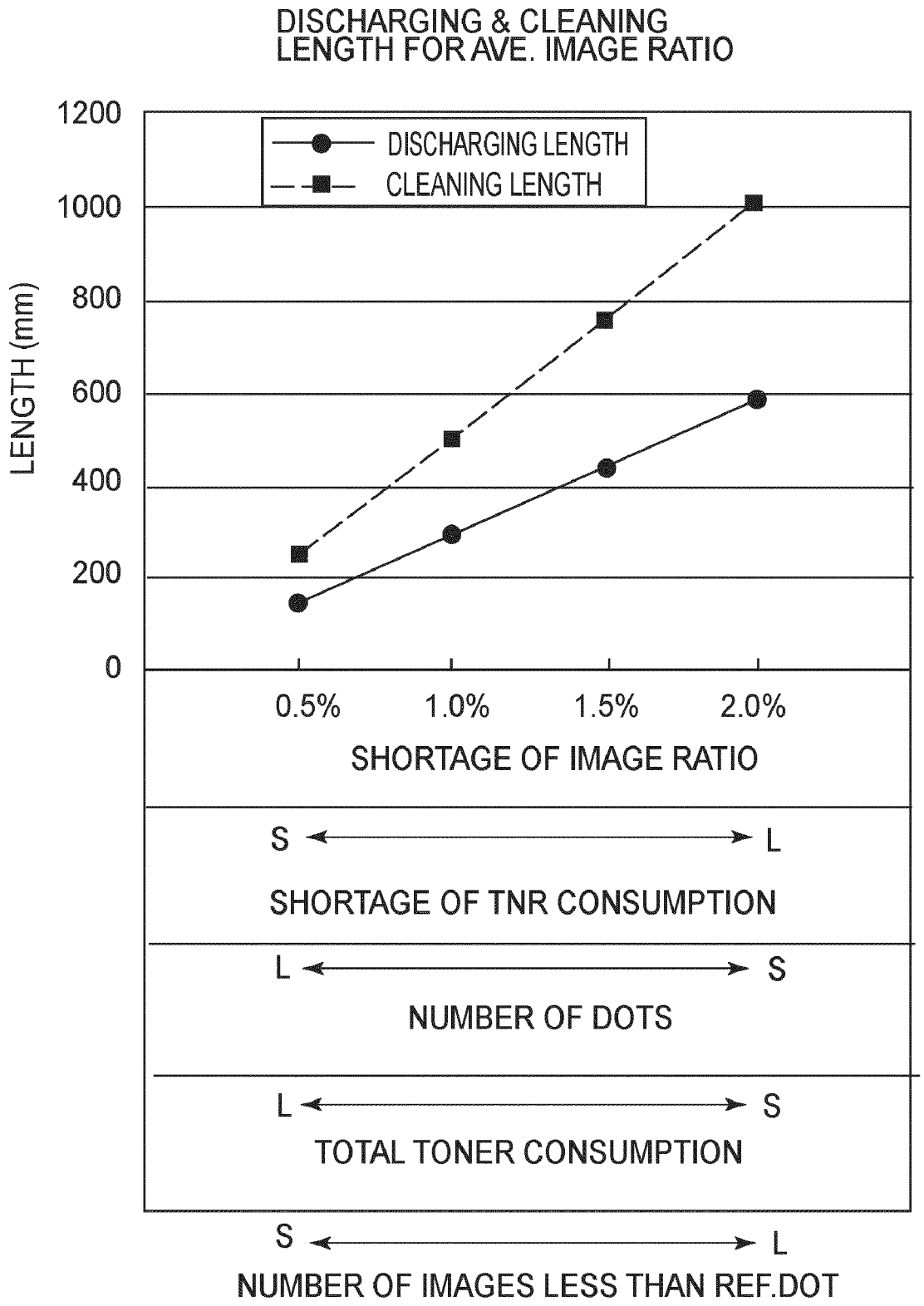
FIG. 6 is a graph which shows the relationship between the average image ratio in a period in which multiple copies (images) were continuously made, and the length of cleaning time.

FIG. 5 is a timing chart of the toner expulsion sequence, and FIG. 6 is a graph which shows the relationship between the average image ratio in an image forming operation in which a substantial number of copies are continuously produced, and the length of the cleaning time.

The control portion 110 causes the image forming apparatus to form a throwaway toner image for every continuous formation of 70 copies, in order to compensate for the total amount of consumption deficit which occurred to each color toner during the continuous formation of the 70 copies. A throwaway toner image is formed on each of the photosensitive drums 101*a*, 101*b*, 101*c*, and 101*d*. The four throwaway toner images are the same in density and width, but, are different in length; the length of each of the four throwaway toner images is set in proportion to the amount of its consumption deficit. Further, the four throwaway toner images are formed with such timing that they are layered in perfect alignment on the intermediary transfer belt 181. That is, the four throwaway toner images formed one for one on the photosensitive drums 101*a*, 101*b*, 101*c*, and 101*d* are different in the total amount of toner; the amount of toner of which each toner image is to be formed is set according to the toner image formation history of each of the developing apparatuses 123*a*, 123*b*, 123*c*, and 123*d*. That is, the yellow, magenta, cyan, and black throwaway toner image are different in length; their length corresponds to the amount of their consumption deficit which occurred while the 70 normal images were continuously formed. Referring to Table 2, while the image forming apparatus 100 is controlled to form throwaway toner images, the voltage applied to the transfer portions T1 and secondary transfer portion T2 are set according to Table 2, which is different from Table 1.

TABLE 2

| Expulsion control | | | | |
|---|---|---|---|---|
| | Low H | Normal H | High H | Remarks |
| 1ry trans. V V | −2000 | −1400 | −1000 | Const. V |
| 2ry trans. V V | −100 | −100 | −100 | Const. V |
| External roller cleaning cur. μA | 12.5 | 12.5 | 12.5 | Const. cur. |

While the image forming apparatus 100 is in the expulsion control mode, the control portion 110 causes the transfer power source D1*a* to output transfer prevention voltage, which is in a range of −2,000 V to 1,000 V, to the transfer roller 124*a*. The transfer prevention voltage is opposite in polarity to the transfer voltage applied during a normal image forming operation. Thus, the throwaway toner image formed on the photosensitive drum 101*a* is not transferred onto the intermediary transfer belt 181 from the photosensitive drum 101*a* which is always in contact with the intermediary transfer belt 181. That is, the throwaway toner image moves through the transfer portion T1, and then, is removed by the cleaning apparatus 112*a*.

Also while the image forming apparatus 100 is in the expulsion control mode, the control portion 110 causes the transfer power source D2 to output transfer prevention voltage, which is −100 V, to the inside secondary transfer roller 127, during the passage of the throwaway toner image through the secondary transfer portion T2. That is, the transfer prevention voltage applied to the inside secondary transfer roller 127 is lower than the transfer voltage applied to the inside secondary transfer roller 127 during a normal image forming operation.

As will be described later, the portion of the intermediary transfer belt 181, which is in contact with the throwaway toner image, is in contact with both the positively charged toner particles and uncharged toner particles (insufficiently charged toner particles). Therefore, if voltage, which is opposite in polarity to the voltage applied during a normal image forming operation, is applied to the inside secondary transfer roller 127, the positively charged toner particles are efficiently transferred onto the outside secondary transfer roller 129, exacerbating the contamination of the outside secondary transfer roller 129 by toner.

However, if voltage, which is in a range of −1,000 V to 4,000 V, that is, voltage which is in the same range as the voltage applied during a normal image forming operation, is continuously applied, electrical discharge occurs between the intermediary transfer belt 181 and outside secondary transfer roller 129, and therefore, these toner particles are likely to become negatively charged. The negatively charged toner particles respond to the negative transfer voltage applied to the inside secondary transfer roller 127, and therefore, efficiently transfer onto the outside secondary transfer roller 129, exacerbating the contamination of the outside secondary transfer roller 129 attributable to toner. These are reasons why the voltage to be applied to the inside secondary transfer roller 127 during the passage of the throwaway toner image through the secondary transfer portion T2 is set to −100 V, which can minimize the amount by which toner adheres to the outside secondary transfer roller 129.

Referring to FIG. 5 as well as FIG. 1, while the image forming apparatus 100 is in an image forming operation for continuously printing a substantial number of copies (images), the control portion 110 controls the apparatus 100 so that images are transferred onto the intermediary transfer belt 181 with a preset interval (100 mm). Then, as the formation of the 70th image is completed, the control portion 110 causes, with the same interval as the preset interval, the exposing apparatus 111*a* to expose the photosensitive drums 101*a* for a length t1 of time to form a throwaway toner image, which has a length of L1, on the peripheral surface of the photosensitive drums 101*a*.

As soon as the formation of the throwaway toner image is completed, the control portion 110 provides a time t2 for cleaning the outside secondary transfer roller 129, creating thereby an area having a length L2, which corresponds to the length of the cleaning time t2, on the peripheral surface of the photosensitive drum 101*a*.

The control portion 110 sets the length of the time t1 for exposing the photosensitive drum 101*a* to form a throwaway toner image, and the length of the time t2 for cleaning the outside secondary transfer roller 129, in proportion to the amount of toner consumption deficit which occurred while the 70 copies were continuously printed, or the number of the copies among the 70 copies, the dot count of which was less than the referential value. The cleaning time t2 is the time which elapses from when a throwaway toner image moves out of the secondary transfer portion T2 to when a sheet of recording medium reaches the second transfer portion T2. In reality, however, the cleaning time t2 includes a short length of time necessary for switching the voltage for the secondary transfer portion T2. During the cleaning time t2, cleaning voltage, that is, the voltage necessary for cleaning, is continuously applied to the conductive fur brushes (143*a* and 143*b* in FIG. 4) of the cleaning apparatus 140.

Therefore, the length L1 of a throwaway toner image, and the length L2 of the portion of the peripheral surface of the peripheral surface 101*a*, across which no image is formed, are proportional to the amount of toner consumption deficit which occurred while the 70 copies (images) were continuously printed, or the number of copies (images), among the 70 copies, the dot count of which was no more than a referential value, as shown in FIG. 6. That is, the lengths L1 and L2 are reversely proportional to the total number of dots made, total amount of toner consumed, and average image ratio (average image ratio of 70 copies), during the above-mentioned period.

More concretely, the control portion 110 uses 2% as the referential image ratio value (relative to image ratio of largest and darkest (highest in density) image formable when A4 sheet of recording medium is fed with its lengthwise edges in parallel to recording medium conveyance direction). If the average image ratio $\alpha$ of the 70 copies (images) having just been continuously made is no more than 2%, the control portion 110 (as cleaning time length adjusting means) multiplies the amount $(2-\alpha)$ of deficit in the image ratio by a constant to obtain the length L1 and L2. Then, it sets the length of the exposing time t1 to a value proportional to the length L1, and the length of the cleaning time t2 to a value proportional to the length L2.

<Example of Toner Expulsion Control>

FIG. 7 is a flowchart of the toner expulsion control sequence. In FIG. 7, the expulsion controlling means, first adjusting means, and second adjusting means, correspond to Step S18, Step S16, and Step S17, respectively.

Referring to FIG. 7 as well as FIG. 1, as a job start signal is inputted, the control portion 110 starts an image forming operation (S11). The control portions calculates the image ratio for each of the primary colors of an image to be printed under a preset condition, and counts the number of copies (images) to be made (S12).

Then, it calculates, for each color, the amount of difference, in terms of toner consumption, between the image ratio of each copy to be made, and the referential value, which in this embodiment is 2%. In other words, it calculates the amount of toner consumption deficit per copy to be made. Then, it causes the image forming apparatus 100 to continue the image forming operation until the cumulative amount of toner consumption deficit reaches a value which corresponds to 100% in terms of image ratio (NO in S14), while comparing the cumulative (total) amount of toner consumed for the copies made, and the value which corresponds to 100% in image ratio (S12-S13).

Then, as the cumulative amount of toner consumption deficit reaches the value equivalent to 100% in image ratio (YES in S14), the control portion 110 determines whether or not the cumulative number of copies (images) made has exceeded PPM (70 copies) (S15). If it determines that the number of the copies made has reached 70 (YES in S15), it calculates the amount by which toner will be consumed to form a throwaway toner image (S16), and calculates the length of the time necessary to clean the outside secondary transfer roller 129, according to the amount by which toner will be consumed to form the throwaway toner image (S17).

For example, in a case where a substantial number of solid white copies of A4 size, that is, copies of A4 size having no toner image of any of the primary colors of the image to be formed, are continuously outputted, the deficit ratio is 2%. Thus, a throwaway toner image, which corresponds in size to an A4 sheet of recording medium, and is highest in density, must be formed for all of the four primary colors, after the printing of 50 copies (images). However, if a throwaway toner image is formed at the highest level of density, the amount by which toner adheres to the intermediary transfer belt 181 in the transfer portion T1 is excessive. Therefore, a single solid image, which corresponds in size to an A3 sheet of recording medium, and ½ the highest level in density, is formed as the throwaway toner image.

Further, the image forming apparatus 100 is designed to form 70 A4 copies (images) per minute (70 ppm). Thus, if the cumulative amount of toner consumption deficit reaches 100% before the cumulative number of A4 copies (images) made reaches 70, a throwaway toner image is formed after the passage of the 70th recording medium.

Therefore, a throwaway toner image which is 588 mm in length (70/50×length of A4 sheet=588) is formed at ½ the highest level of density, in the period between the completion of the 70th copy (image) and the starting of the formation of the 71st copy (image), as shown in FIG. 6. Incidentally, in this case, it is assumed that 70 solid white copies were continuously yielded. Further, the length of the time for cleaning the outside secondary transfer roller 129 is 3.35 seconds (which corresponds to recording medium interval of 1008 mm).

For example, in a case where a substantial number of copies (images) which are A4 in size and 1% in image ratio are continuously yielded, a solid toner image which corresponds in size to an A3 sheet of recording medium must be formed as a throwaway toner image at ½ the highest level of density after the formation of 100th copy (image). Therefore, a solid toner image which is 294 mm in length (70/100×length of A3 sheet=294), is formed as the throwaway toner image between the completion of the 70th copy (image) and the starting of the 71st copy (image), as shown in FIG. 6. In this case, the length of the time set for cleaning the outside secondary transfer roller 129 is 1.69 seconds (which corresponds to paper interval of 505 mm).

As described above, in this embodiment, the amount of toner consumed for forming a throwaway toner, and the length of time for cleaning the outside secondary transfer roller 129, are adjusted according to the image ratio. In other words, when a throwaway toner image is short, the length of time for cleaning is reduced to increase the productivity of the image forming apparatus 100.

After the completion of the formation of the 70th copy (image), the control portion 110 causes the image forming apparatus 100 to form a throwaway toner image (S18). Then, it affords the image forming apparatus 100 the time for cleaning the outside secondary transfer roller 129, which starts as the portion of the intermediary transfer belt 181, to which toner particles have transferred from the throwaway toner image in the second transfer portion T2, arrives at the cleaning apparatus 140 (S19). If a throwaway toner image is formed during one of the paper intervals in an image forming operation in which a substantial number of copies (images) are continuously printed, before a preset number of copies are made, the cumulative counter for the amount of deficit in image ratio is reset (S20).

If the job has to be continued (NO in S21), the control portion 110 puts the image forming apparatus 100 back into the interrupted normal image forming operation to form the next copy (image) (S11), and causes the image forming apparatus 100 to continue the operation until the job is completed (YES in S21).

Incidentally, a person in charge of the image forming apparatus 100 can change the setting of the apparatus, through an unshown control terminal connected to the image forming apparatus 100 (control portion 110). If productivity is priority, the referential image ratio, relative to which the amount of toner consumption deficit is calculated to determine the timing with which a throwaway toner image is to be formed, may be changed from 2% to 1.5%. Further, the relationship between the amount of toner which will be consumed for the formation of a throwaway toner image, and the length of time provided for cleaning the outside secondary transfer roller 129, can be set according to both the physical length of a throwaway image and the length of time necessary to form the throwaway image, making it possible to optimize the length of time the image forming apparatus 100 needs to be kept on standby, according to the ambient condition and/or the amount of wear of the cleaning member (cumulative length of usage of cleaning member).

Embodiment 2

Figure 8:
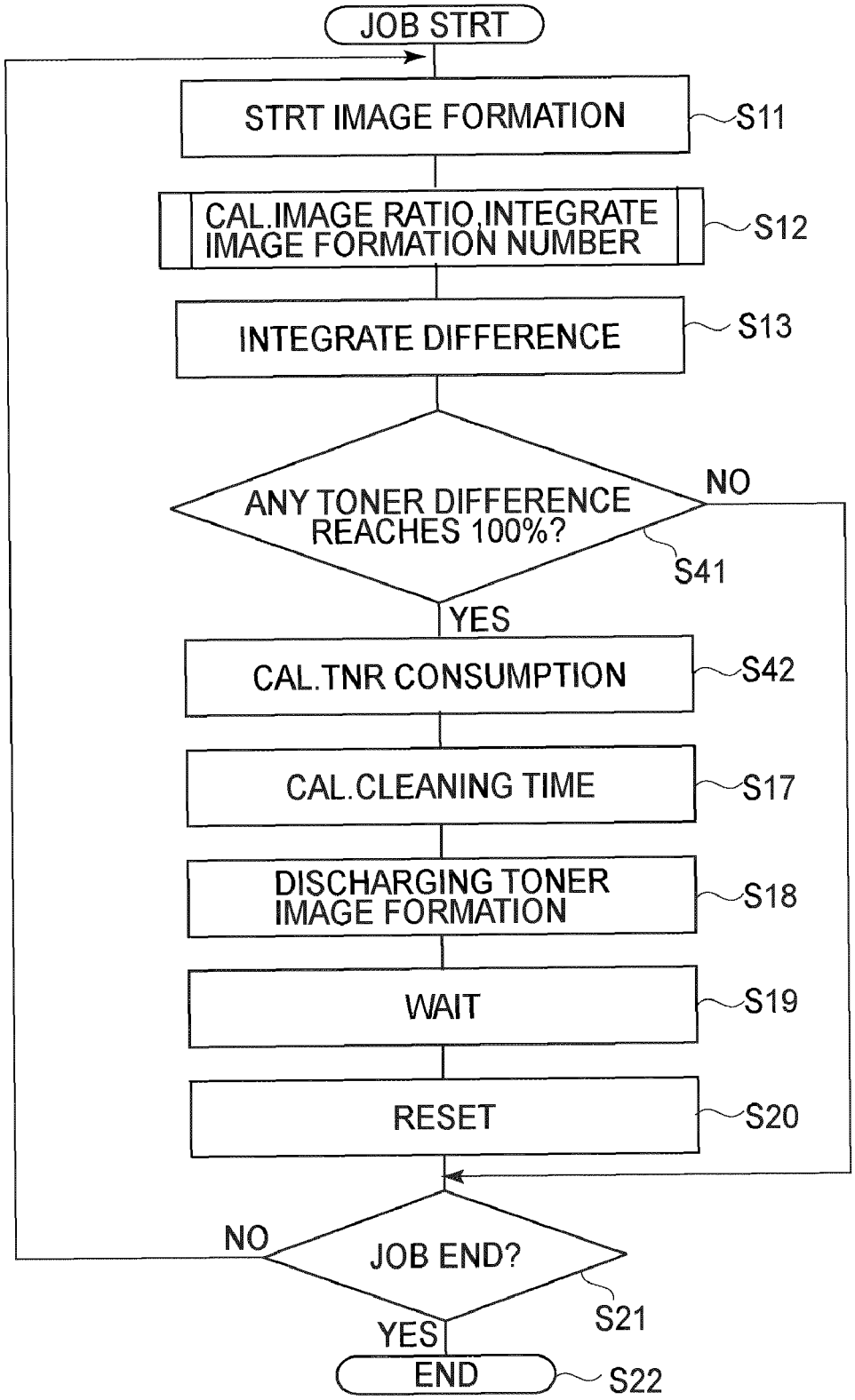
FIG. 8 is a flowchart of the toner expulsion sequence in the second embodiment.

FIG. 8 is a flowchart of the toner expulsion sequence in the second embodiment of the present invention. In terms of structure, the image forming apparatus in this embodiment is the same as the image forming apparatus 100 in the first embodiment. This embodiment is different from the first embodiment only in that the toner expulsion sequence in this embodiment is partially different from that in the first embodiment. Therefore, this embodiment will be described with reference to FIG. 8 as well as FIGS. 1-7. The steps in FIG. 8, which are the same as those in FIG. 7, will be given the same referential symbols as those given to the corresponding steps in FIG. 7, and will not be described here in order to prevent the repetition of the same descriptions.

Also in the second embodiment, the cumulative amount of toner consumption deficit is obtained for each of the primary colors. Then, as the cumulative amount of toner consumption deficit for any of the four primary colors reaches a value which corresponds to an image ratio of 100%, a throwaway toner image is formed on all the photosensitive drums 101. Onto the photosensitive drums 101 which use the toner, the consumption deficit of which has reached a value which corresponds to the image ratio of 100%, toner is expelled by an amount proportional to 100% of toner consumption deficit. As for the color toners, the cumulative amounts of consumption deficit of which have not reached the value which corresponds to the image ratio of 100%, they are expelled onto the photosensitive drums 101 by the amounts proportional to the cumulative amount of consumption deficit which occurred prior to the starting of the toner expulsion sequence. While the image forming apparatus 100 is controlled to expel toner from the developing apparatus which uses the toner, the cumulative consumption deficit of which has reached the value which corresponds to the image ratio of 100%, toners can be also expelled from the other developing apparatuses. Therefore, this embodiment is smaller in the frequency with which the toner expulsion sequence has to be carried out.

Referring to FIG. 8, if the cumulative amount of the consumption deficit of any of the yellow, magenta, cyan, and black toners reaches the value equivalent to 100% in image ratio (YES in S41), the control portion 110 calculates the amount of consumption deficit for each of the toners, the consumption deficit of which has not reached the value equivalent to 100% in image ratio (S42).

For example, assuming that the cumulative amount of consumption deficit of the black toner has reached the value equivalent to 100% in image ratio, and the cumulative amount of consumption deficits of the yellow, magenta, and cyan toners are all equivalent to 30% in image ratio, a solid black toner image which corresponds in size to a single A4 sheet of recording medium is formed as a throwaway toner image at the highest level of density. As for the yellow, magenta, and cyan toners, the cumulative amounts of consumption deficit of which are equivalent to 30% in image ratio, solid yellow, magenta, and cyan toner images, the sizes of which are equal to ⅓ of the size of an A4 sheet, are formed as throwaway images at the highest level of density.

Figure 9:
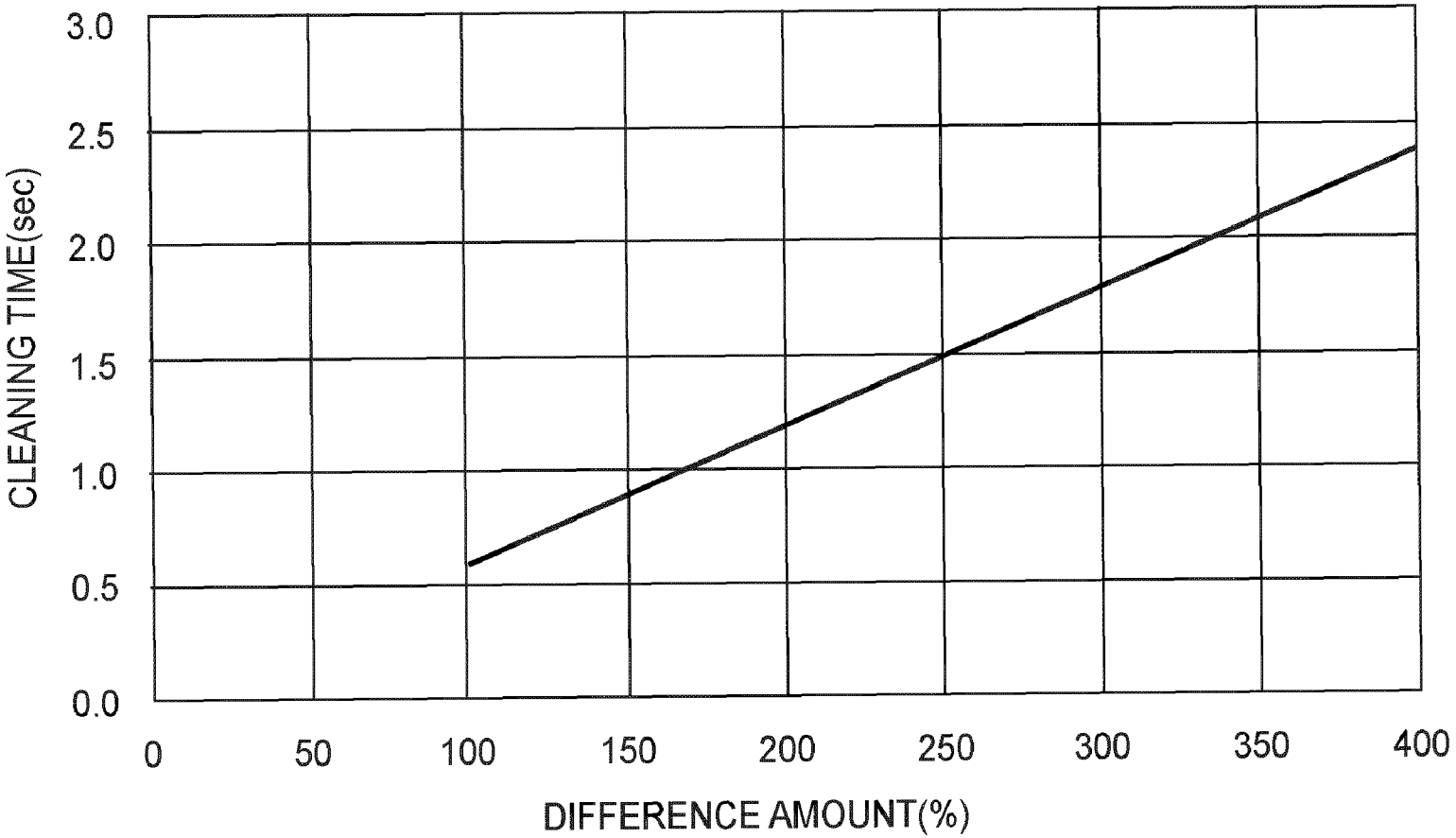
FIG. 9 is a graph which shows the relationship between the toner consumption deficit and the length of cleaning time, in the second embodiment.

Then, the length of time necessary to clean the outside secondary transfer roller 129 is calculated. FIG. 9 is a graph which shows the relationship between the total (horizontal axis) of the cumulative amounts of consumption deficit of the yellow, magenta, cyan, and black toners when the toner expulsion sequence was started, and the calculated length of time necessary for cleaning (vertical axis), in the second embodiment. In the above-described case, the cumulative amount of black toner consumption deficit is equivalent to 100% in image ratio, and the cumulative amounts of yellow toner consumption deficit, magenta toner consumption deficit, and cyan toner consumption deficit are all equivalent to 33.3% in image ratio. Therefore, the total of the cumulative amounts of toner consumption deficit of the four color toners is 200%. Thus, the control 110 sets the length of cleaning time to 1.20 seconds based on the relationship in FIG. 9.

Incidentally, also in this embodiment, yellow, magenta, cyan, and black throwaway toner images are formed at ½ the highest level of density on the photosensitive drums 101*a*, 101*b*, 101*c*, and 101*d*, respectively, with such a timing that they will be layered in perfect alignment on the intermediary transfer belt 181 (S18). Then, as soon as the throwaway toner images move past the secondary transfer portion T2, the image forming apparatus 100 is put on standby in terms of image formation, and is kept on standby while the toner particles from the throwaway toner image, which remain adhered to the outside secondary transfer roller 129, are removed (S19). The amount by which toner is to be used to form a throwaway toner image is affected by the image formation history of the image forming portion P which uses the toner. In this embodiment, therefore, the length of time provided for cleaning the outside secondary transfer roller 129 in the toner expulsion sequence is adjusted according to the image formation history of the image forming portion Pa, making it possible to minimize the length of time during which an image cannot be formed. As soon as the time provided for the cleaning expires, the referential value for calculating the cumulative amount of toner consumption deficit is reset (S20). If it is necessary to continue the interrupted job (NO in S21), the job is restarted (S11), and is continued until it is finished (YES in S21).

Embodiment 3

Figure 10:
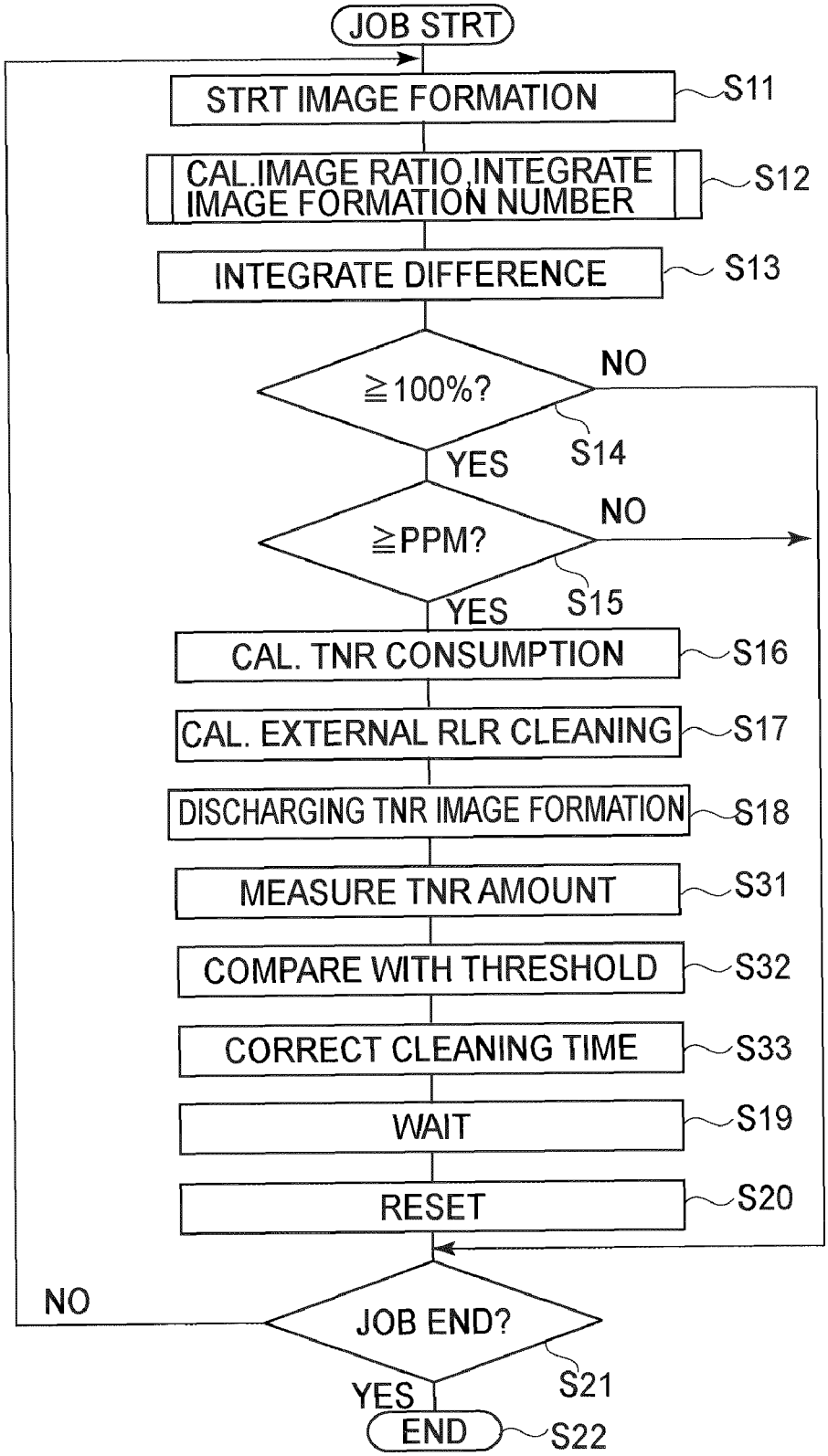
FIG. 10 is a flowchart of the toner expulsion sequence in the third embodiment.

FIG. 10 is a flowchart of the toner expulsion sequence in the third embodiment of the present invention. In terms of the structure of the image forming apparatus (100), the third embodiment is the same as the first and second embodiments. It is different from the first and second embodiments only in that its toner expulsion sequence, which is controlled by the control portion 110, is partially different from those in the first and second embodiments. Therefore, this embodiment will be described with reference to FIG. 10 as well as FIGS. 1-7. The steps in FIG. 10, which are the same as those in FIG. 7, will be given the same referential symbols as those given to the corresponding steps in FIG. 7, and will not be described here in order to prevent the repetition of the same descriptions.

Referring to FIG. 1, the image forming apparatus 100 is provided with an optical sensor 151, which is an example of means for measuring toner density. The optical sensor 151 is located on the downstream side of the image forming portion Pd, and is positioned so that it directly faces the intermediary transfer belt 181. The output of the optical sensor 151, which reflects the density level of the toner on the intermediary transfer belt 181, is inputted into the control portion 110. In the third embodiment, the control portion 110 estimates the amount by which toner particles will adhere to the outside secondary transfer roller 129, based on the toner density of the portion of the intermediary transfer belt 181 which has just been in contact with the throwaway toner image. Then, if the estimated amount is greater than a referential value, the control portion 110 extends the time t2 for cleaning the outside secondary transfer roller 129 shown in FIG. 4, and if the estimated amount is less than the referential value, the control portion 110 shortens the cleaning time t2.

The amount by which toner transfers from the photosensitive drum 101*a* onto the intermediary transfer belt 181 in the transfer portion T1 is affected by the extent of the deterioration of the structural components, such as the intermediary transfer belt 181, photosensitive drum 101*a*, and developing apparatus 123*a*, and also, the environmental factors. Therefore, in order to ensure that the toner particles on the intermediary transfer belt 181, which are traceable to the throwaway toner images, are entirely removed regardless of the changes in the above-mentioned factors, the length of the cleaning time t2 must be set in anticipation of the worst state of deterioration of the structural components and the worst environmental condition. However, if the length of the cleaning time t2 is set based on the worst state of deterioration of the structural components and worst environmental condition, it may be unnecessarily long when the image forming apparatus 100 is relatively new, and/or when the image forming apparatus 100 is operated under the normal environment. In other words, such a practice may unnecessarily reduce the image forming apparatus 100 in productivity.

In the third embodiment, therefore, the image forming apparatus 100 is provided with the optical sensor 151 for detecting the density of toner particles on the intermediary transfer belt 181 (which is example of intermediary transfer member), which are traceable to the throwaway toner images. The control portion 110 estimates the amount by which the toner particles in the throwaway toner images will adhere to the intermediary transfer belt 181, based strictly on the changes in the output of the optical sensor 151, that is, without taking the extent of the deterioration of the structural components and environmental factors. In other words, in this embodiment, the cleaning time t2 is optimized in length by estimating, as accurately as possible, the amount of the toner which will have to be removed by the cleaning apparatus 140, and therefore, it is possible to prevent the problem that the starting of the formation of the next normal image is unnecessarily delayed.

Referring to FIG. 10, the control portion 110 measures the toner density (amount of toner) as soon as the portion of the intermediary transfer belt 181, which has come into contact with the throwaway toner image, arrives at the location of the optical sensor 151 (S31). Then, it compares the actually measured toner density with a threshold value (S32), and adjusts the length of the time for cleaning the outside secondary transfer roller 129 (S33). Then, it puts the image forming apparatus 100 on standby in terms of image formation, to clean the outside secondary transfer roller 129, with the timing with which the portion of the intermediary transfer belt 181, which is carrying the toner particle traceable to the throwaway toner images, arrives at the secondary transfer portion T2 (S19), and resets the cumulative counter for the amount of deficit in image ratio is reset (S20). Then, after the elapse of the cleaning time, which has been adjusted in length, the control portion 110 restarts the interrupted normal image forming operation (S21-S14).

Therefore, if the toner density is too high relative to the length of the time provided for the cleaning of the outside secondary transfer roller 129, the cleaning time t2 is extended, whereas if the toner density is too low, the cleaning time t2 is shortened. Thus, not only can this embodiment make it possible to prevent the formation of defective images, which is attributable to developer deterioration, but also, can satisfactorily clean the outside secondary transfer roller 129 and intermediary transfer belt 181, preventing thereby the recording medium P from being soiled on its back side, while minimizing the amount of reduction in productivity.

The image forming apparatus in the third embodiment is provided with a detecting means (151) for detecting the toner on the intermediary transfer belt (181), which is traceable to the throwaway toner images. The second adjusting means (110) adjusts the length of the cleaning time t2, based on the results of detection by the detecting means (151).

Embodiment 4

Figure 11:
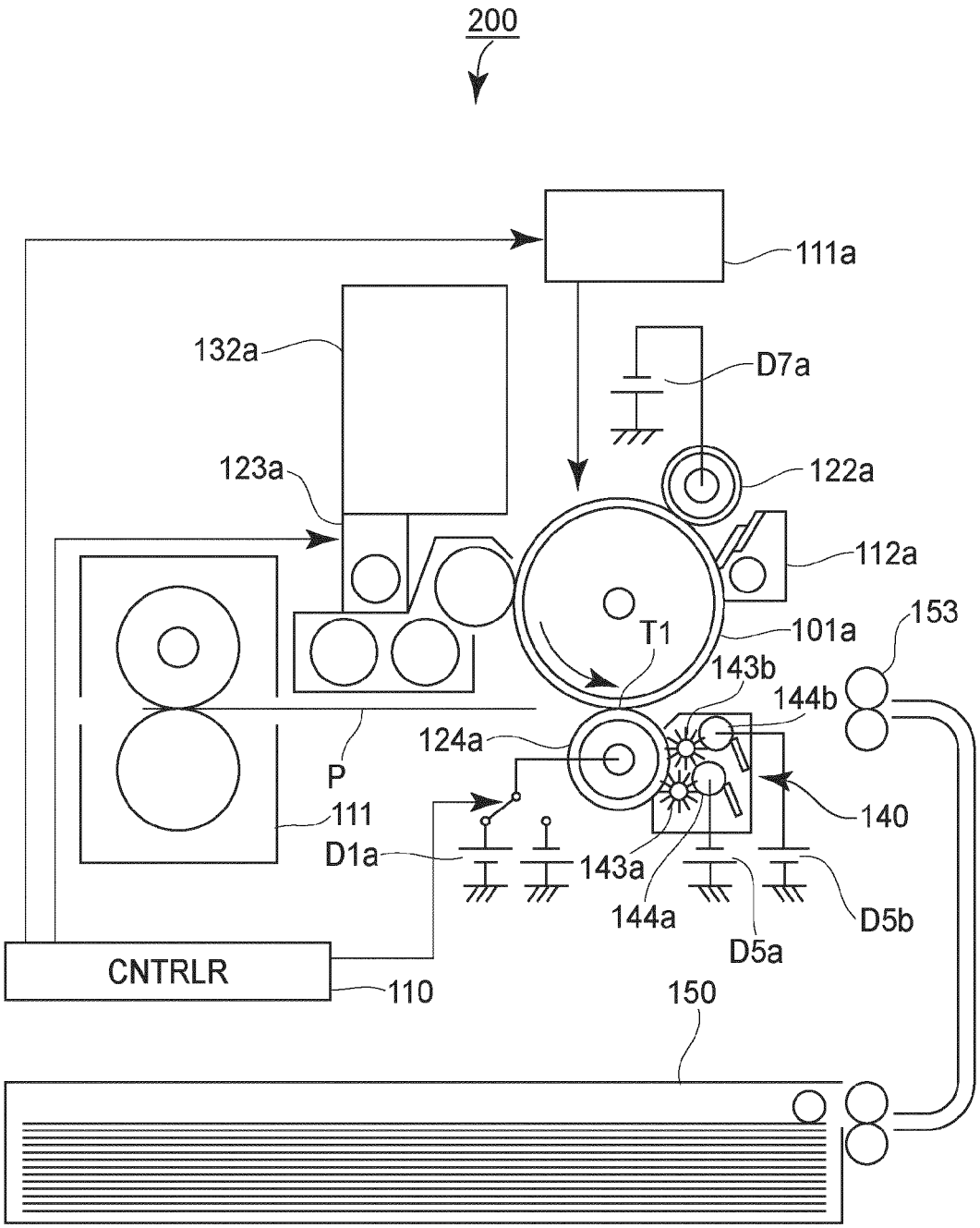
FIG. 11 is a schematic sectional view of the image forming apparatus in the fourth embodiment, and shows the general structure of the apparatus.

FIG. 11 is a schematic sectional view of the image forming apparatus in the fourth embodiment, and shows the structure of the apparatus. The image forming apparatus 200 in the fourth embodiment is not provided with an intermediary transfer belt. In other words, it directly transfers a toner image formed on the photosensitive drum 101*a*, onto a recording medium in the nip (transfer portion T1) between the photosensitive drum 101*a* and transfer roller 124*a*. The image forming apparatus in the fourth embodiment is a monochromatic image forming apparatus which has only a single image forming portion, such as the image forming portion Pa of the image forming apparatus 100 in the first embodiment, and forms only monochromatic images. The structural components in FIG. 11, which are identical to those of the image forming apparatus 100 in the first embodiment, are given the same referential symbols as those used in FIG. 1, and will not be described to prevent the repetition of the same descriptions.

Referring to FIG. 11, the image forming apparatus 200 uniformly charges the peripheral surface of its rotating photosensitive drum 101*a* using its charging apparatus 122*a*, and writes an electrostatic image, which corresponds to an original image, on the peripheral surface of the photosensitive drum 101*a*, by scanning (exposing) the uniformly charged portion of the peripheral surface of the photosensitive drum 101*a* with a beam of light emitted by its exposing apparatus 111*a*. The developing apparatus 123*a* of the image forming apparatus 200 adheres charged toner to the electrostatic image to develop the electrostatic image into a toner image.

The toner image on the photosensitive drum 101*a* is conveyed by the rotation of the photosensitive drum 101*a*, to the transfer portion T1, which is the area of contact between the photosensitive drum 101*a*, and the transfer roller 124 kept pressed against the photosensitive drum 101*a*. Meanwhile a substantial number of sheets of recording medium stored in the sheet feeder cassette 150 are pulled out one by one from the cassette 150, and are fed one by one into the main assembly of the image forming apparatus 200. As each recording medium is fed into the main assembly, it is kept on standby by a pair of registration rollers 153. Then, the recording medium is released, and conveyed further, by the registration rollers 153 with such a timing that it arrives at the transfer portion T1 at the same time as the toner image on the photosensitive drum 101*a* arrives at the transfer portion T1.

In the transfer portion T1, transfer voltage, the polarity of which is opposite that of the normally charged toner, is outputted from a transfer power source D1*a*. As a result, the toner image on the photosensitive drum 101*a* is directly transferred onto the recording medium while the recording medium is conveyed through the transfer portion T1 with the toner image layered on the recording medium.

The developing apparatus 123*a* contains two-component developer, which is a combination of toner and magnetic carrier. As the two-component is stirred in the developing apparatus 123*a*, the toner is given a preset amount of electric charge. It has been known that, in a case where a substantial number of copies, which are no more than 2% in image ratio, are continuously printed, the toner in the developing apparatus 123*a* fails to be given a proper amount of electric charge, making it likely for the image forming apparatus 200 to form unsatisfactory images, for example, images which are coarse in appearance and nonuniform in density, and/or suffer from fog.

Therefore, also in the case of the image forming apparatus 200, a throwaway toner image, that is, a toner image which is not to be transferred on to recording medium, is formed on the photosensitive drum 101*a* for every 70 copies made, in order to compensate for the total amount of toner consumption deficit, which occurred during the continuous formation of the 70 copies.

Referring to 11 as well as FIG. 5 (however, intermediary transfer belt 181 is to be read as photosensitive drum 100*a*), normal images are continuously formed on the photosensitive drum 101*a* with the presence of a preset amount of interval, which corresponds to the amount of paper interval. Immediately after the completion of the 70th image, a throwaway toner image is formed on the photosensitive drum 101*a*. While the throwaway toner image is moved through the transfer portion T1, transfer prevention voltage, the polarity of which is the same as that of the normally charged toner, is applied to the transfer roller 124*a*. Therefore, most of the toner particles in the throwaway toner image move through the transfer portion T1, unaffected by the voltage applied to the transfer roller 124*a*, that is, without adhering to the transfer roller 124*a*. Then, they are removed by the cleaning apparatus 112*a*.

However, it is possible that a small amount of toner particles in the throwaway toner image will adhere to the transfer roller 124*a*, and will soil the back side of the recording medium which is delivered to the transfer portion T1 to transfer the next normal image onto the recording medium.

Thus, after the elapse of the time t1 for exposing the photosensitive drum 101*a* to form a throwaway toner image, the rotation of the photosensitive drum 101*a* is continued for a certain length of time (cleaning time t2) for cleaning. Then, after the elapse of the cleaning time t2, the step in which the photosensitive drum 101*a* is exposed to produce the 71st copy (image) is started. Therefore, a blank area having a length L2 is effected on the immediately downstream side of the throwaway toner image, on the peripheral surface of the photosensitive drum 101*a*.

Referring to FIG. 6, the length L1 of the throwaway toner image and the length L2 of the blank area are adjusted in proportion to the cumulative amount of difference between the average image ratio of the 70 copies which were continuously made prior to the formation of the throwaway toner image, and the referential image ratio of 2%.

For example, in a case where 70 copies which are 1% in image ratio are continuously produced, the cumulative amount of toner consumed for the production of the 70 copies is equivalent to 70% in image ratio, that is, 70% of the total amount of toner consumed to form a single solid black copy (image). Therefore, a toner image, the toner contents of which is equal to 70% (70/100×length of A3 sheet=294 mm) of the toner contents of a single solid black toner image, must be formed as a throwaway toner image. It is assumed that the length of time for cleaning for transfer roller 124*a* is 1.67 seconds (which corresponds to 504 mm).

Therefore, the transfer roller 124*a*, to which a certain amount of toner in the throwaway toner image has adhered, is cleaned by the cleaning apparatus 140 during the cleaning time t2. Incidentally, the cleaning apparatus 140 is provided with a pair of electrically conductive fur brushes 143*a* and 143*b*, which are charged to the negative and positive polarities by the bias rollers 144*a* and 144*b*, respectively, so that both the positively charged toner particles and negatively charged toner particles can be removed from the transfer roller 124*a*.

In other words, each time a throwaway toner image is formed, the length of the cleaning time t2 is set based on the actual amount of toner which is used for forming the throwaway toner image. Therefore, the image forming apparatus 200 can be prevented from being kept on standby in terms of image formation, for an unnecessary length of time to clean the transfer roller 124*a*, that is, to remove the toner traceable to the throwaway toner image, from the transfer roller 124*a*.

That is, according to this embodiment, the image forming operation interrupted for the formation of a throwaway toner image can be restarted sooner than in a case where the length of cleaning time is set to the value corresponding to the paper interval of 1008 mm which was determined, assuming that 70 copies which were 0% in image ratio were continuously formed. In other words, this embodiment can increase the length of time in which the image forming apparatus 200 is actually used for image formation; it can increase an image forming productivity.

In the fourth embodiment, as soon as the number of prints completed in a given job reaches a preset value, a toner expulsion sequence is started by the control portion 110. In the toner expulsion sequence, toner is expelled from all the developing apparatuses, based on the cumulative amount of toner consumption deficit which occurred during the period between when the preceding toner expulsion sequence was carried out in the given job, and when a preset number of prints are completed since the preceding toner expulsion sequence, in the given job. This practice is for preventing the problem that a toner expulsion sequence is started immediately after the restarting of the job interrupted for a toner expulsion sequence. In a toner expulsion sequence, toner is expelled from a developing apparatus by the amount which is proportional to the cumulative amount of toner consumption deficit at the end of the production of the preset number of prints in the given job.

Also in this case, the control portion 110 adjusts the amount by which toner is to be expelled, based on the image formation history between the completion of the preceding toner expulsion sequence in the given job and the completion of the printing of the preset number of copies, in the given job. Then, in order to produce the next copy (normal image) as soon as possible, the control portion 110 adjusts the length of time for cleaning the transfer roller 124*a*, based on the image formation history between the completion of the preceding toner expulsion sequence in the given job and the completion of the printing of the preset number of copies.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 028596/2007 filed Feb. 7, 2007, which is hereby incorporated by reference.

What is claimed is:

1. An image forming apparatus comprising:

a belt member;

toner image forming means for forming a toner image on said belt member;

a stretching member for stretching said belt member at an inside of said belt member;

a transfer member, pressed against said stretching member through said belt member, for forming a transfer portion for transferring a first toner image onto a recording material;

a fur brush for electrostatically cleaning said transfer member;

a controller for controlling a voltage for applying to said stretching member to transfer the first toner image onto the recording material by applying a first voltage of a predetermined polarity to said stretching member when the first toner image passes through said transfer portion; and an executing portion for executing an ejecting operation for forming by said toner image forming means, on said belt member, a second toner image in the form of a band which is not transferred onto the recording material, wherein when said executing portion executes the ejecting operation, said stretching member is supplied with a second voltage which has the predetermined polarity and which has an absolute value smaller than an absolute value of the first voltage for transferring the first toner image onto the recording material, and subsequently, said fur brush electrostatically cleans said transfer member.

2. An apparatus according to claim 1, wherein a duration in which said fur brush electrostatically cleans said transfer member is controlled such that the duration increases with an increase in dimension of the second toner image.

3. An apparatus according to claim 1, wherein said toner image forming means includes:

a plurality of image bearing members; and transferring means for transferring the toner image onto said belt member from said plurality of image bearing members, wherein a duration in which said fur brush electrostatically cleans said transfer member is controlled such that the duration increases with an increase in the number of image bearing members from which the second toner image is transferred onto said belt member.

* * * * *